US007108348B2

(12) United States Patent
Shinkawa et al.

(10) Patent No.: US 7,108,348 B2
(45) Date of Patent: Sep. 19, 2006

(54) DROPLET EJECTING APPARATUS AND EJECTION ABNORMALITY DETECTING/DETERMINING METHOD FOR A DROPLET EJECTING HEAD

(75) Inventors: Osamu Shinkawa, Chino (JP); Yusuke Sakagami, Shiojiri (JP)

(73) Assignee: Seiko Epson Corporation, (JP)

( * ) Notice: Subject to any disclaimer, the term of this patent is extended or adjusted under 35 U.S.C. 154(b) by 289 days.

(21) Appl. No.: 10/789,940

(22) Filed: Feb. 27, 2004

(65) Prior Publication Data

US 2004/0227782 A1 Nov. 18, 2004

(30) Foreign Application Priority Data

Feb. 28, 2003 (JP) ..... 2003-055020

(51) Int. Cl.
*B41J 29/393* (2006.01)
*B41J 29/38* (2006.01)
*B41J 2/045* (2006.01)

(52) U.S. Cl. ..... 347/19; 347/10; 347/70

(58) Field of Classification Search ..... 347/19, 347/70, 10

See application file for complete search history.

(56) References Cited

U.S. PATENT DOCUMENTS

| | | | | |
|---|---|---|---|---|
| 4,034,380 | A * | 7/1977 | Isayama | 347/19 |
| 4,498,088 | A * | 2/1985 | Kanayama | 347/92 |
| 5,500,657 | A * | 3/1996 | Yauchi et al. | 347/9 |
| 5,818,473 | A * | 10/1998 | Fujii et al. | 347/9 |
| 6,375,299 | B1 * | 4/2002 | Foster et al. | 347/19 |
| 2002/0089562 | A1 * | 7/2002 | Simons et al. | 347/19 |

FOREIGN PATENT DOCUMENTS

| | | | |
|---|---|---|---|
| EP | 0 933 215 | A2 | 2/1999 |
| EP | 1 147 900 | A1 | 4/2000 |
| EP | 1 211 078 | A1 | 7/2001 |
| JP | 63-141750 | | 6/1988 |
| JP | 02-003323 | | 1/1990 |
| JP | 08-309963 | | 11/1996 |
| JP | 11-334102 | | 12/1999 |
| JP | 2000-272116 | | 10/2000 |
| JP | 2002-187263 | | 7/2002 |

OTHER PUBLICATIONS

Communication from JPO re: related PCT application No. PCT/JP2004/002401.
Communication from JPO re: related PCT application No. PCT/JP2004/002403.
Communication from JPO re: related PCT application No. PCT/JP2004/002437.
Communication from JPO re: related PCT application No. PCT/JP2004/002405.
Communication from JPO re: related PCT application No. PCT/JP2004/002400.
Communication from JPO re: related PCT application No. PCT/JP2004/002443.
Communication from JPO re: related PCT application No. PCT/JP2004/002390.
Communication from European Patent Office re: counterpart application.

* cited by examiner

*Primary Examiner*—Lamson Nguyen
*Assistant Examiner*—Jannelle M. Lebron
(74) *Attorney, Agent, or Firm*—Harness, Dickey & Pierce, P.L.C.

(57) ABSTRACT

A droplet ejecting apparatus and an ejection abnormality detecting/determining method are provided that, depending upon a capacitance change of an actuator after a droplet ejecting operation, measures the period of residual vibration on the vibration plate to thereby enable detection of an ejection abnormality and determination of a cause thereof.

16 Claims, 29 Drawing Sheets

After adhesion of paper powder

Before adhesion of paper powder

DROPLET EJECTING APPARATUS AND EJECTION ABNORMALITY DETECTING/DETERMINING METHOD FOR A DROPLET EJECTING HEAD

RELATED APPLICATIONS

The present application claims priority to Japanese Patent Application No. 2003-055020 filed Feb. 28, 2003 which is hereby expressly incorporated by reference herein in its entirety.

BACKGROUND OF THE INVENTION

1. Technical Field

The present invention relates to a droplet ejecting apparatus and ejection abnormality detecting/determining method for a droplet ejecting head.

2. Related Art

The ink jet printer, as a droplet ejecting apparatus, forms an image on a predetermined paper by ejecting ink droplets from a plurality of nozzles. The ink jet printer has a print head (ink jet head) provided with a plurality of nozzles. However, clogging possibly takes place at certain nozzles due to ink viscosity increase, air bubble mixing, dust or paper powder adhesion or the like, resulting in impossible ink ejection. Nozzle clogging causes dot missing in the printed image, raising a cause of image deterioration.

Conventionally, there has been devised, as a method of detecting such an ejection abnormality of ink droplets (hereinafter referred also to as "dot missing"), a method of optically detecting a state that an ink droplet is not to be ejected at the ink jet head nozzles (ink droplet ejection abnormality) (e.g. JP-A-8-309963, etc.). This method makes it possible to specify a nozzle causing dot missing (ejection abnormality).

However, in the above optical dot-missing (droplet ejection abnormality) detecting method, a detector including a light source and optical sensor is attached on the droplet ejecting apparatus (e.g. ink jet printer). In this detection method, there is generally a problem that the light source and the optical sensor must be set up with accuracy so that the droplet ejected at the droplet ejection head (ink jet head) nozzle can pass through between the light source and the optical sensor, to thereby block the light between the light source and the optical sensor. In addition, such a detector is usually expensive, which problematically raises the manufacturing cost of ink jet printers. Furthermore, there is a possibility that the ink mist from the nozzles and paper powder of printing papers, etc. cause contamination in the light-source output part and optical-sensor detector part, resulting in a problematic reliability in the detector.

Meanwhile, in the above optical type dot-missing detecting method, although detection is possible for dot missing at the nozzles, i.e., ink-droplet ejection abnormality (non-ejection), the cause of dot missing (ejection abnormality) cannot be specified (determined) depending upon the detection result. Thus, there is a problem of impossibility to select and carry out a suitable recovery process corresponding to the cause of dot missing. Consequently, despite the state being recoverable by a wiping process for example, ink is pump-out from the ink jet head, thus increasing waste ink (useless ink). Otherwise, instead of doing the proper recovery process, a plurality of recovery steps is carried out to thereby lower or degrade the throughput over the ink jet printer (droplet ejecting apparatus).

It is an object of the present invention to provide a droplet ejecting apparatus and ejection abnormality detecting/determining method for a droplet ejecting head that, depending upon a capacitance change on a vibration plate of an actuator after droplet ejecting operation, the period of residual vibration on the vibration plate is measured to thereby detect an ejection abnormality on the droplet ejection head and determine a cause of the ejection abnormality.

SUMMARY

In order to solve the above problem, in an embodiment of the present invention, a droplet ejecting apparatus of the invention includes:

a droplet ejecting head having a vibration plate, an actuator for displacing the vibration plate, a cavity filled with a liquid at an interior thereof and having an interior pressure to be increased and decreased by displacement of the vibration plate, and a nozzle communicating with the cavity and for ejecting the liquid as a droplet depending upon an increase and decrease of the pressure within the cavity;

a drive circuit for driving the actuator; and an ejection abnormality detecting device having a residual vibration detecting device for detecting residual vibration of the vibration plate displaced by the actuator after the actuator is driven by the drive circuit, to detect an abnormality of droplet ejection depending upon a vibration pattern of residual vibration of the vibration plate detected by the residual vibration detecting device.

According to the droplet ejecting apparatus of the present invention, when carrying out an operation to eject a liquid as a droplet by driving the actuator, residual vibration of the vibration plate displaced by the actuator is detected. Depending upon a vibration pattern of residual vibration of the vibration plate, detection is made as to whether a droplet has been normally ejected or not been ejected (ejection abnormality).

The droplet ejecting apparatus of the present invention does not require another part (e.g. optical detecting device, etc.) as compared to the droplet ejecting apparatus having the conventional dot-missing detecting method. Accordingly, it is possible to detect a droplet-ejection abnormality and to suppress manufacturing costs, without increasing the size of the droplet ejection head. Meanwhile, in the droplet ejecting apparatus of the present invention, because the residual vibration on the vibration plate after ejection is used to detect a droplet-ejection abnormality, the droplet-ejection abnormality can be detected even during a printing operation.

Herein, residual vibration of the vibration plate refers to a state that the vibration plate continues vibrating while attenuating due to a droplet ejecting operation in the duration or after the actuator carries out a droplet ejecting operation according to a drive signal (voltage signal) of the drive circuit and before a droplet ejecting operation is again made by inputting the next drive signal.

Meanwhile, preferably, the ejection abnormality detecting device includes a determining device for determining a presence or absence of a droplet ejection abnormality on the droplet ejection head depending upon the vibration pattern of residual vibration of the vibration plate. Preferably, the determining device, when determining a presence of a droplet ejection abnormality on the droplet ejection head, determines a cause of the ejection abnormality. Herein, the vibration pattern of residual vibration of the vibration plate may include a period of the residual vibration. Due to this, it is possible to determine a cause of a droplet ejection abnormality that is not determined by the conventional device for detecting dot missing, such as the optical detecting device. Due to this, it is possible to select and carry out a suitable recovery process for the cause, as required.

Herein, preferably, when the period of residual vibration of the vibration plate is shorter than a period of a predetermined range, the determining device determines that there is an air bubble mixed in the cavity. When the period of residual vibration of the vibration plate is longer than a predetermined threshold, a determination is made that a thickened liquid exists in the vicinity of the nozzle by drying. Preferably, when the period of residual vibration of the vibration plate is longer than a period of a predetermined range but shorter than a predetermined threshold, the determining device determines that there is paper powder adhered in the vicinity of an exit of the nozzle. Incidentally, in the present invention, "paper powder" is not limited to paper powder merely produced from a recording (printing) paper, but also refers to anything adhered in the vicinity of the nozzle and blocking droplet ejection, including for example rubber chips such as a paper feed roller and dust floating in the air.

Incidentally, a droplet ejecting apparatus of the present invention may further include a storage device for storing a result of the determination by the determining device. Due to this, depending on a determination result stored, it is possible to carry out a suitable recovery process on a suitable occasion, e.g., after ending a print operation.

Meanwhile, a droplet ejecting apparatus of the present invention preferably further includes a switch device for switching after a droplet ejecting operation by the actuator, the actuator from the drive circuit over to the ejection abnormality detecting device. In this manner, after driving the actuator, the actuator is disconnected from the drive circuit, thereby detecting residual vibration of the vibration plate. Consequently, a droplet ejection abnormality can be detected without undergoing the influence of noise caused by the drive circuit.

Meanwhile, preferably, the residual vibration detecting device has an oscillation circuit, the oscillation circuit oscillating based on a capacitance component of the actuator and varying depending upon a residual vibration of the vibration plate. The oscillation circuit may constitute a CR oscillation circuit having a capacitance component of the actuator and a resistance component of a resistance element connected to the actuator. In this manner, the droplet ejecting apparatus of the invention detects a residual vibration waveform (residual vibration voltage waveform) on the vibration plate as a chronological slight change (oscillation period change) in an actuator capacitance component. Accordingly, in the case of using a piezoelectric element as the actuator, it is possible to correctly detect a residual vibration waveform on the vibration plate without relying on the magnitude of the electromotive voltage thereof.

Herein, preferably, the oscillation circuit has an oscillation frequency configured to be one figure higher than a vibration frequency of the residual vibration of the vibration plate. By thus setting the oscillation frequency of the oscillation circuit at a frequency several tens of times a vibration frequency of the residual vibration of the vibration plate, the residual vibration of the vibration plate can be detected more correctly. This makes it possible to detect more correctly a droplet ejection abnormality.

Meanwhile, preferably, the residual vibration detecting device includes an F/V conversion circuit for generating a voltage waveform of the residual vibration of the vibration plate from a predetermined signal group generated based on an oscillation frequency change in an output signal of the oscillation circuit. By thus generating a voltage waveform with the use of the F/V conversion circuit, the detection sensitivity can be set great when detecting a residual vibration waveform without any effect given to actuator driving.

Furthermore, preferably, the residual vibration detecting device includes a waveform shaping circuit for shaping a voltage waveform of the residual vibration of the vibration plate generated by the F/V conversion circuit into a predetermined waveform. Preferably, the waveform shaping circuit includes a DC component removing device for removing a direct-current component from a voltage waveform of residual vibration of the vibration plate generated by the F/V conversion circuit, and a comparator for comparing between a voltage waveform removed of the direct-current component by the DC component removing device and a predetermined voltage value, the comparator generating and outputting a rectangular wave depending upon a voltage comparison.

Meanwhile, preferably, the ejection abnormality detecting device includes a measuring device for measuring a period of the residual vibration of the vibration plate from the rectangular wave generated by the residual vibration detecting device. Furthermore, the measuring device has a counter. The counter may count pulses of a reference signal to thereby measure a time between the rising edges of the rectangular waves or the rising and falling edges thereof. By thus using a counter to measure a period of a rectangular wave, it is possible to detect a period of the residual vibration on the vibration plate more simply and correctly.

Incidentally, the actuator may be an electrostatic actuator or a piezoelectric actuator utilizing a piezoelectric effect of a piezoelectric element. The droplet ejecting apparatus of the present invention can use not only an electrostatic actuator made by a capacitor as described above but also a piezoelectric actuator. Thus, the invention can be applied to almost all existing droplet ejecting apparatuses.

In another embodiment of the invention, a droplet ejecting head ejection abnormality detecting/determining method is characterized in that: after carrying out an operation that ejects a liquid within a cavity as a droplet from a nozzle by driving an actuator to vibrate a vibration plate, the residual vibration of the vibration plate is detected, to thereby detect a droplet ejection abnormality and determine a cause thereof depending upon a detected vibration pattern of the residual vibration of the vibration plate.

DETAILED DESCRIPTION

Hereafter, explanations will be made in detail of the preferred embodiments of a droplet ejecting apparatus and ejection abnormality detecting/determining method for a droplet ejecting head of the present invention, with reference to FIGS. 1 to 30. Incidentally, the embodiments are shown as exemplifications, and hence the invention should not be interpreted as limited to those. Incidentally, the following embodiments are explained using an ink jet printer for printing an image on a recording. (printing) paper by ejecting ink (liquid material), as one example of the droplet ejecting apparatus of the present invention.

FIRST EMBODIMENT

Figure 1:
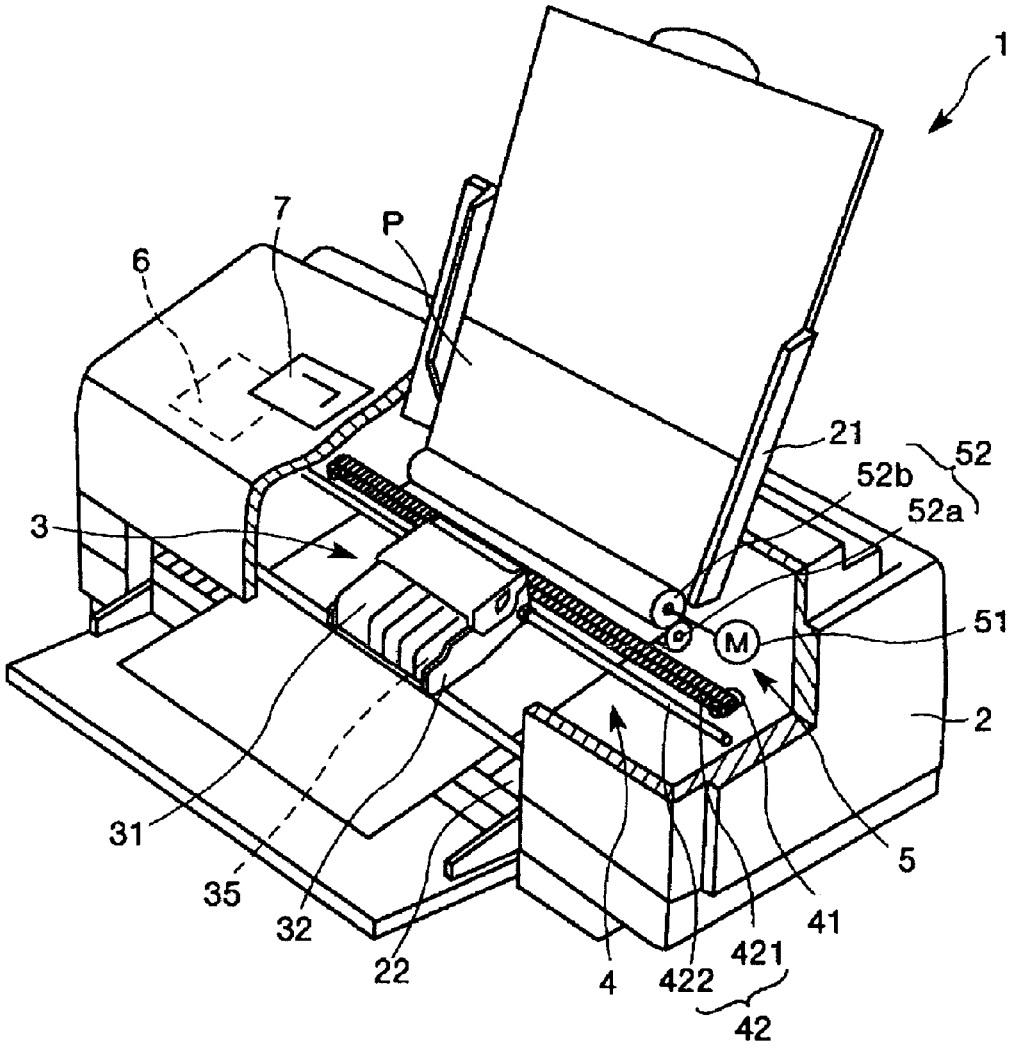
FIG. 1 is a schematic view showing a structure of an ink jet printer which is one of the droplet ejecting apparatuses of the present invention.

FIG. 1 is a schematic view showing a construction of an ink jet printer 1 as one example of a droplet ejecting apparatus according to a first embodiment of the present invention. Incidentally, in the following explanation, the upper side in FIG. 1 is referred to as the "upper" while the lower side therein is as the "lower". At first, an explanation is made regarding the construction of the ink jet printer 1.

The ink jet printer 1 shown in FIG. 1 is provided with an apparatus main body 2 having a tray 21 in the upper rear thereof for placing a recording paper P, an exit port 22 in the lower front thereof for the recording paper P to exit, and an operation panel 7 in the upper surface thereof.

The operation panel 7 is configured, for example, by a liquid crystal display, an organic EL display, or an LED lamp, to have a display part (not shown) for displaying an error message, etc. and an operating part (not shown) structured by various switches and the like.

Meanwhile, the apparatus main body 2 has therein, mainly, a printing device (printing means) 4 having a character-printing device (movable body) 3 movable reciprocally, a paper feed device (paper feed means) 5 for delivering the recording paper P sheet by sheet to the printing device 4, and a control section (control means) 6 for controlling the printing device 4 and the paper feed device 5.

Under control of the control section 6, the paper feed device 5 feeds the recording paper P sheet by sheet intermittently. The recording paper P passes through a vicinity of the lower part of the character-printing device 3. At this time, the character-printing device 3 reciprocally moves in a direction nearly orthogonal to the direction of feeding the recording paper P, thereby printing on the recording paper P. Namely, the reciprocal movement of the character-printing device 3 and the intermittent feed of recording paper P provides main and sub scanning, to perform printing in an ink jet system.

The printing device 4 has the character-printing device 3, a carriage motor 41 serving as a drive source for moving the character-printing device 3 in the main scanning direction, and a reciprocal-motion mechanism 42 receiving rotation of the carriage motor 41 and moving the character-printing device 3 reciprocally.

The character-printing device 3 has, in its lower part, a plurality of head units 35 having a multiplicity of nozzles 110 corresponding to the kinds of ink, a plurality of ink cartridges (I/C) 31 for supplying ink to the head units 35, and a carriage 32 mounting the head units 35 and ink cartridges 31 thereon.

Meanwhile, the head unit 35 has a multiplicity of ink jet type recording heads (ink jet heads or droplet ejecting heads) 100 each having a nozzle 110, a vibration plate 121, an electrostatic actuator 120, a cavity 141, an ink supply port 142 and the like, as hereinafter described in FIG. 3. Incidentally, the head unit 35, although shown in the construction including the ink cartridge 31 in FIG. 1, is not limited to such a structure. For example, the ink cartridges 31 may be separately fixed for supplying by tubes or the like to the head unit 35. Accordingly, in the following, separately from the character-printing device 3, the provision with a plurality of ink jet heads 100 each structured by a nozzle 110, a vibration plate 121, an electrostatic actuator 120, a cavity 141, an ink supply port 142 and the like, is referred to as a head unit 35.

Incidentally, by using the ink cartridges 31 filled with four-color inks of, for example yellow, cyan, magenta, and black, full color printing is made possible. In this case, the character-printing device 3 is provided with head units 35 corresponding to the respective colors. Herein, although FIG. 1 shows four ink cartridges 31 corresponding to the four colors, the character-printing device 3 may be further structured to have other ink cartridges 31, e.g. in light cyan, light magenta, and dark yellow.

The reciprocal movement mechanism 42 has a carriage guide shaft 422 supported at both ends by a frame (not shown) and a timing belt 421 extending parallel with the carriage guide shaft 422.

The carriage 32 is supported for reciprocal movement over the carriage guide shaft 422 of the reciprocal movement mechanism 42, and fixed on a part of the timing belt 421.

In case the timing belt 421 is moved forward/reverse via a pulley by operating the carriage motor 41, the character-printing device 3 is guided along the carriage guide shaft 422 into reciprocal movement. During the reciprocal movement, ink is suitably ejected at nozzles 110 of the plurality of ink jet heads 100, in a manner corresponding to the image data (print data) for printing. Thus, printing is performed on the recording paper P.

The paper feed device 5 has a paper feed motor 51 serving as its drive source and a paper feed roller 52 to be rotated by the operation of the paper feed motor 51.

The paper feed roller 52 is structured by a following roller 52*a* and a drive roller 52*b* that are placed vertically oppositely sandwiching a feed path (recording paper P) of the recording paper P. The drive roller 52*b* is coupled to the paper feed motor 51. This allows for the paper feed roller 52 to deliver one by one a multiplicity of sheets of recording paper P toward the printing device 4. Incidentally, in place of the tray 21, the structure may be removably attached with a paper feed cassette containing a recording paper P.

The control section 6 controls the printing device 4, the paper feed device 5 and the like depending upon the printing data inputted from a host computer 8, such as a personal computer (PC) or a digital camera (DC), thereby making a printing process to the recording paper P. Meanwhile, the control section 6 causes a display part of the operation panel 7 to display an error message or the like, or LED lamp or the like to go on and/or flicker. Furthermore, it causes each part to carry out the corresponding process depending upon a depression signal of various switches inputted from the operating part.

Figure 2:
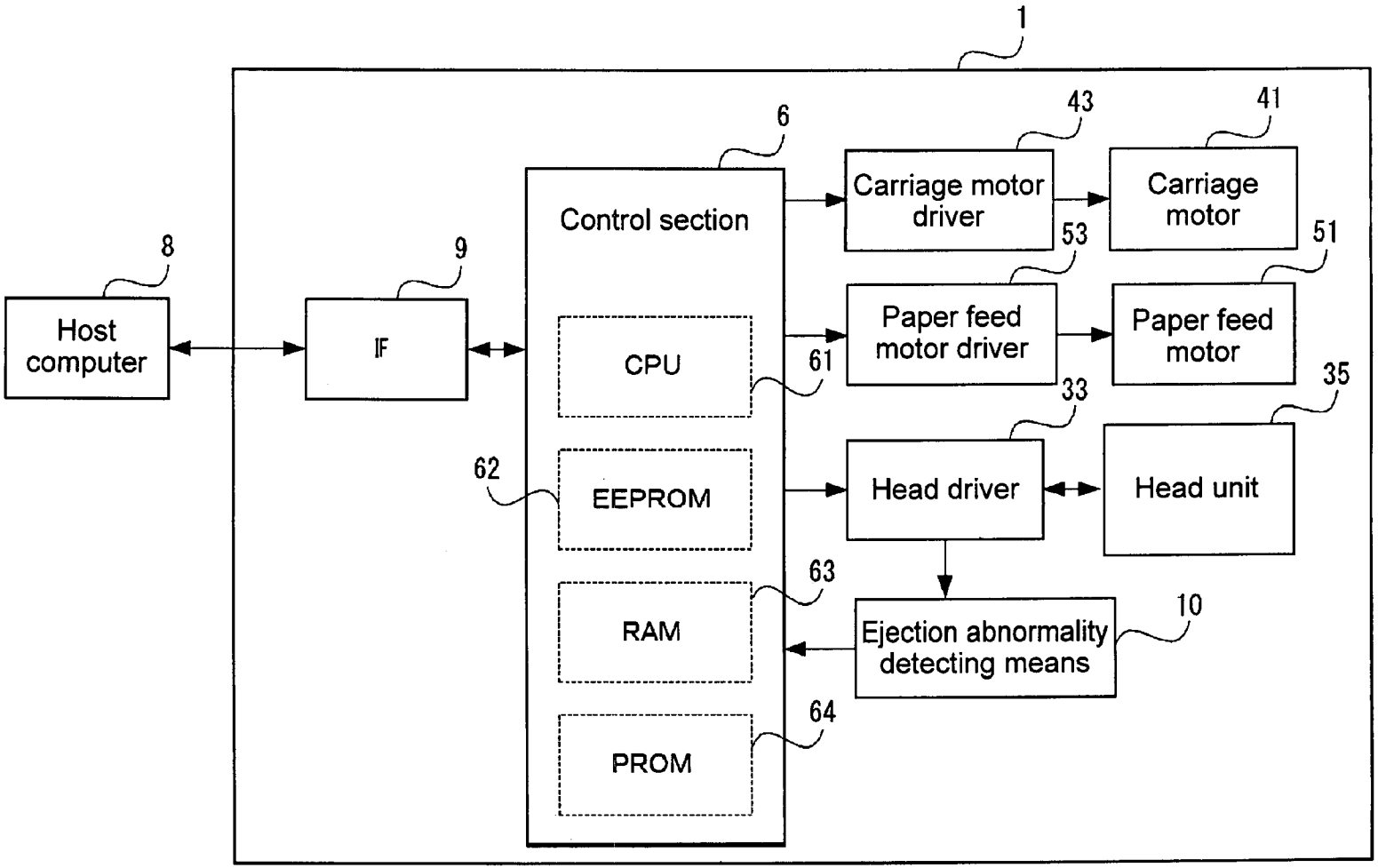
FIG. 2 is a block diagram schematically showing the major part of the ink jet printer of the present invention.

FIG. 2 is a block diagram schematically showing one part of the ink jet printer of the present invention. In FIG. 2, the ink jet printer 1 of the present invention has an interface (IF) 9 for receiving the printing data inputted from the host computer 8, the control section 6, the carriage motor 41, a carriage motor driver 43 for drive-control the carriage motor 41, the paper feed motor 51, a paper feed motor driver 53 for drive-control the paper feed motor 51, the head unit 35, a head driver 33 for drive-controlling the head unit 35, and an ejection-abnormality detecting device 10. Incidentally, the ejection-abnormality detecting device 10 and the head driver 33 will be detailed later.

In FIG. 2, the control section 6 has a CPU (Central Processing Unit) 61 for executing various processes such as a printing process and ejection-abnormality detecting process, an EEPROM (Electrically Erasable Programmable Read Only Memory) (storage means) 62 as one kind of a non-volatile semiconductor memory for storing the printing data inputted through the IF 9 from the host computer 8 to a data storage area (not-shown), a RAM (Random Access Memory) 63 for temporarily storing various data upon executing a hereinafter described ejection-abnormality detecting process or temporarily expanding an application program such as for a printing process, and a PROM 64 as one kind of a non-volatile semiconductor memory for storing a control program and the like to control various parts. Incidentally, the constituent elements of the control section 6 are electrically connected together through a bus (not-shown).

As described above, the character-printing device 3 is structured by the plurality of head units 35 corresponding to the respective colors of ink. Each head unit 35 has a plurality of nozzles 110, and electrostatic actuators 120 (a plurality of ink jet heads 100) corresponding to the respective nozzles 110. Namely, the head unit 35 is constructed having the plurality of ink jet heads (droplet ejection heads) 100 each having a set including a nozzle 110 and an electrostatic actuator 120. The head driver 33 is configured by a drive circuit 18 for driving the electrostatic actuator 120 of each ink jet head 100 and controlling ink ejection timing, and a switch device 23 (see FIG. 16). Incidentally, the structure of the ink jet head 100 and electrostatic actuator 120 will be described later.

Meanwhile, the control section 6 is electrically connected with various sensors capable of detecting printing environments, including an amount of ink remaining in the ink cartridge 31 and a position, temperature and humidity of the character-printing device 3 for example, though not shown.

The control section 6, when acquiring printing data from the host computer 8 through the IF 9, stores the printing data to the EEPROM 62. The CPU 61 executes a predetermined process on the printing data, and outputs drive signals to the respective drivers 33, 43, and 53 depending upon the processed data and the input data from the sensors. These drive signals, if inputted through the drivers 33, 43, and 53, operate the electrostatic actuators 120 corresponding to the plurality of ink jet heads 100 of the head unit 35, the carriage motor 41 of the printing device 4, and the paper feed device 5, respectively. Due to this, a printing operation is effected on the recording paper P.

Figure 4:
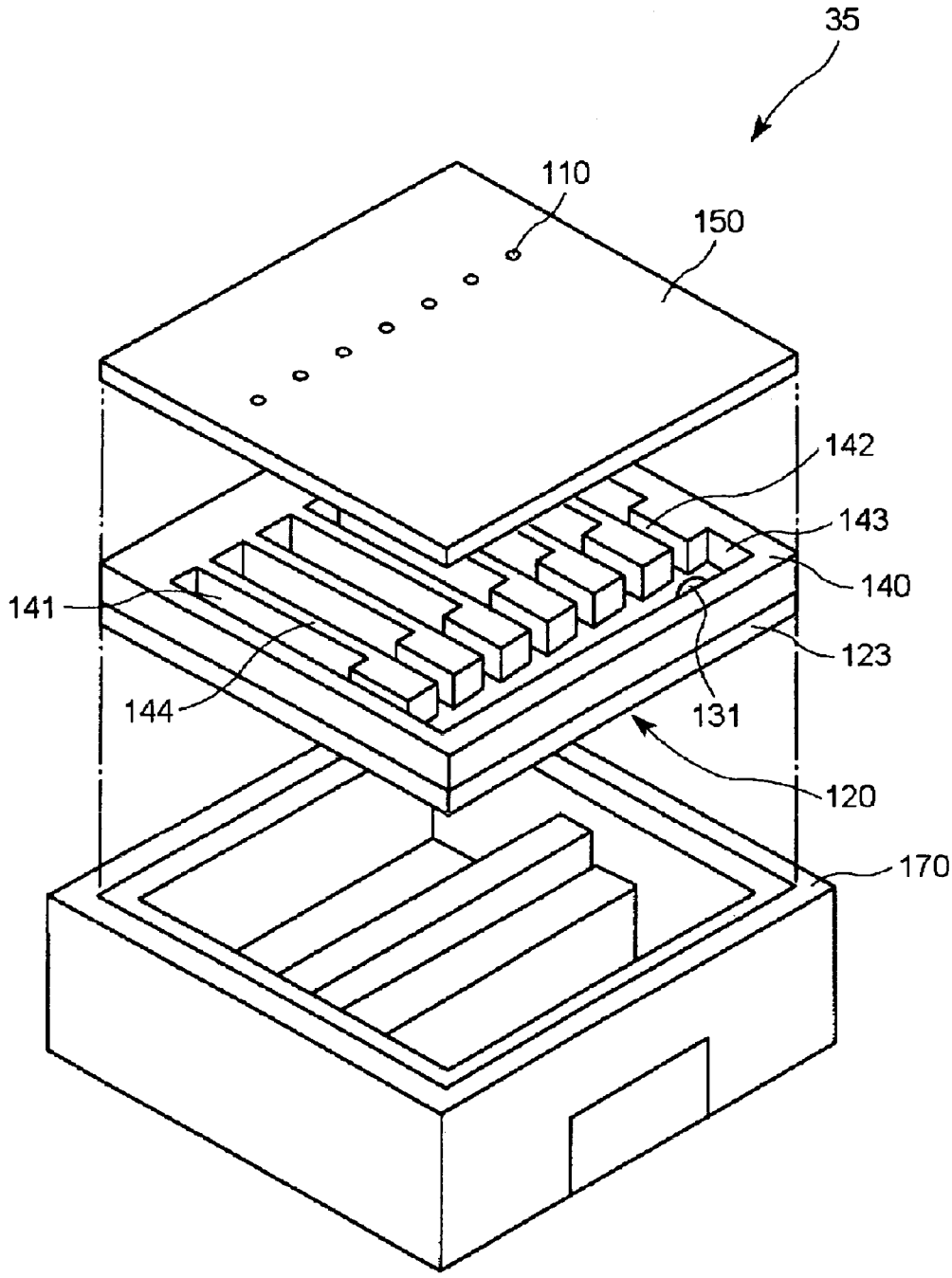
FIG. 4 is an exploded perspective view showing a construction of a head unit 35 corresponding to the one-color ink shown in FIG. 1.
Figure 5:
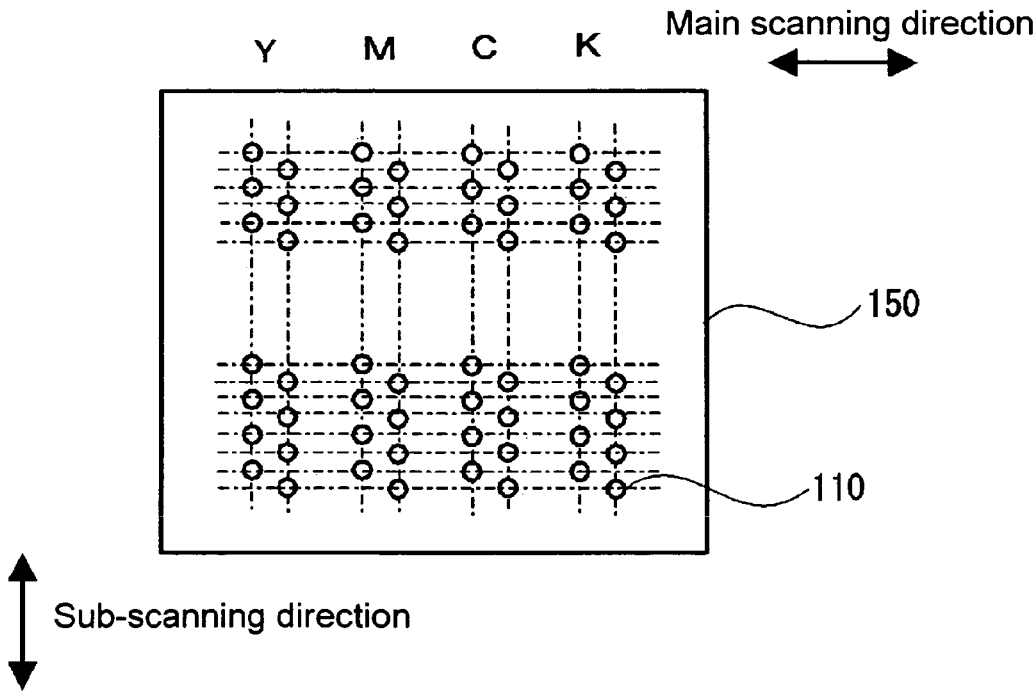
FIG. 5 is one example of a nozzle arrangement pattern on a nozzle plate of a head unit using four-color ink.

Now, an explanation is made regarding the construction of the ink jet head 100 within each head unit 35. FIG. 3 is a schematic sectional view of one ink jet head 100 within the head unit 35 shown in FIG. 2 (including a common part, such as the ink cartridge 31). FIG. 4 is an exploded perspective view showing a schematic structure of the head unit 35 corresponding to one color of ink. FIG. 5 is a plan view showing one example of a nozzle surface of the head unit 35 applied with a plurality of the ink jet heads 100 shown in FIG. 3. Note that FIGS. 3 and 4 show a vertical inversion to the state of usual use. FIG. 5 is a plan view of the ink jet head 100 shown in FIG. 3 as viewed from above in the figure.

Figure 3:
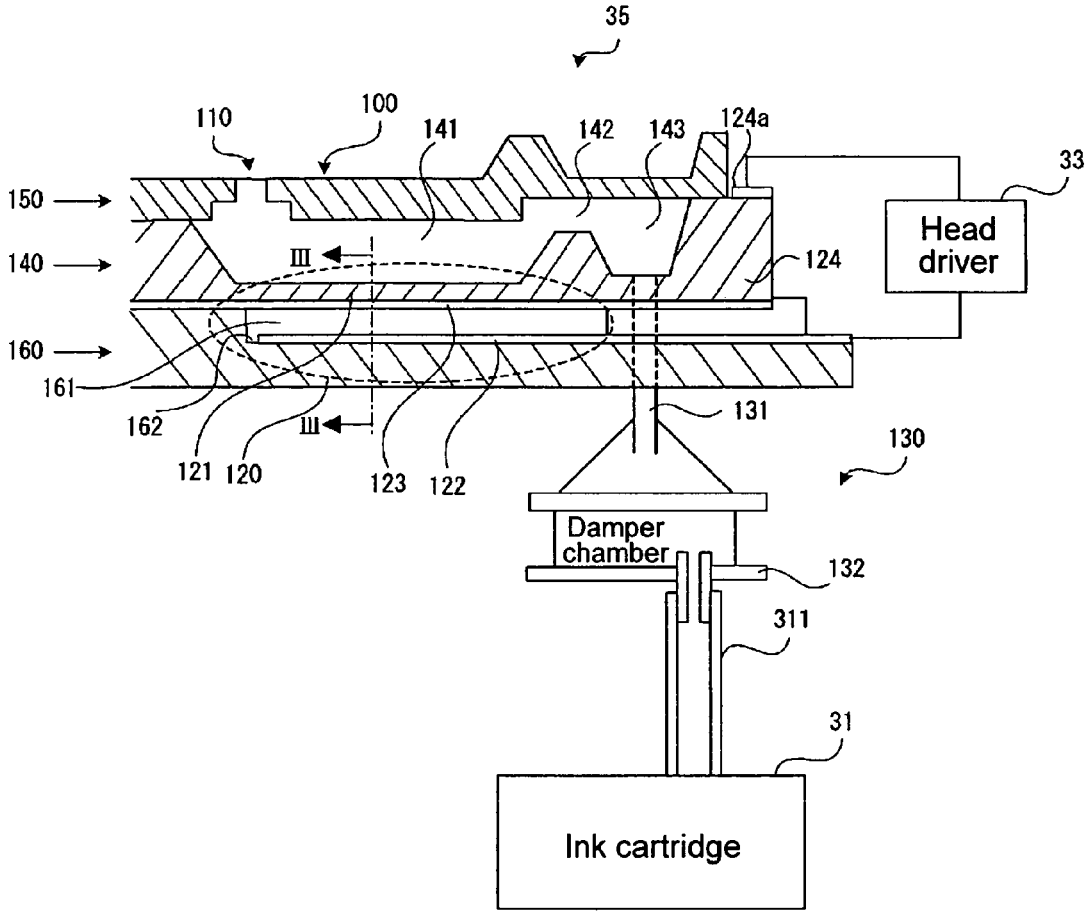
FIG. 3 is a schematic sectional view of the ink jet head shown in FIG. 1.

As shown in FIG. 3, the head unit 35 is connected to the ink cartridge 31 through an ink intake port 131, a damper chamber 130, and an ink supply tube 311. Herein, the damper chamber 130 has a damper 132 formed of rubber. The damper chamber 130 can afford to absorb the swing and pressure change of ink during reciprocal movement of the carriage 32. This can stably supply a predetermined amount of ink to the ink jet heads 100 of the head unit 35.

Meanwhile, the head unit 35 is in a three-layer laminated structure, sandwiching a silicon substrate 140 by an upper nozzle plate 150 made similarly of silicon and a lower borosilicate glass substrate (glass substrate) 160 having a thermal expansion coefficient approximate to that of silicon. The central silicon substrate 140 is formed with the plurality of independent cavities (pressure chambers) 141 (seven cavities shown in FIG. 4), one reservoir (common ink chamber) 143, grooves respectively serving as the ink supply ports (orifices) 142 for communicating the reservoir 143 with the cavities 141. The grooves can be formed by performing etching on the surface of the silicon substrate 140. The nozzle plate 150, the silicon substrate 140, and the glass substrate 160 are bonded together in this order, to form the cavities 141, the reservoir 143, and the ink supply ports 142 by partitioning.

These cavities 141 are each formed in a rectangular form, the bulk of which is to be varied by vibration (displacement) of the vibration plate 121, hereinafter described. By such bulk change, ink (liquid material) is ejected at the nozzle (ink nozzle) 110. The nozzle plate 150 is formed with nozzles 110 in positions corresponding to the tips of the cavities 141 and in communication with the respective cavities 141. Also, an ink intake port 131, communicating with the reservoir 143, is formed through the glass substrate 160 in an area where the reservoir 143 is positioned. Ink is passed from the ink cartridge 31 via the ink supply tube 311 and damper chamber 130 to the ink intake port 131 and supplied to the reservoir 143. The ink supplied to the reservoir 143 is supplied to the independent cavities 141 through the respective ink supply ports 142. Incidentally, the cavities 141 are formed in partitions by the nozzle plate 150, sidewalls (partition walls) 144, and bottom wall 121.

The independent cavity 141 has the bottom wall 121 formed to be thin-walled. The bottom wall 121 is structured to function as a vibration plate (diaphragm) to elastically deform (elastically displace) outward with respect to the plane thereof (in a thickness direction), i.e., in a vertical direction in FIG. 3. Accordingly, the part of bottom wall 121 may be referred to as the vibration plate 121 in explanation, for the convenience of explanation (i.e., reference 121 is hereinafter used for the both of "bottom wall" and "vibration plate").

In the surface of the glass substrate 160 close to the silicon substrate 140, shallow recesses 161 are respectively formed in positions corresponding to the cavities 141 of the silicon substrate 140. The bottom wall 121 of the cavity 141 is opposed, with predetermined spacing, to the surface of an opposite wall 162 of the glass substrate 160 formed with the recess 161. Namely, a predetermined thickness (e.g., about 0.2 microns) of an air gap exists between the bottom wall 121 of the cavity 141 and a segment electrode 122, hereinafter described. Note that the recess 161 can be formed by etching, for example.

Herein, the bottom wall (vibration plate) 121 of the cavity 141 constitutes a part of common electrode 124 on the side of cavities 141 for storing charges depending upon a drive signal supplied from the head driver 33. Namely, the vibration plate 121 of the cavity 141 serves also as one of the opposed electrodes (capacitor's opposed electrode) of the electrostatic actuator 120, hereinafter described. In the recess 161 surface of the glass substrate 160, the segment electrodes 122 facing the common electrode 124 are formed in a manner opposed to the bottom wall 121 of the cavity 141. Meanwhile, as shown in FIG. 3, the surface of the bottom wall 121 of the cavity 141 is covered with an insulation layer 123 of silicon oxide film ($SiO_2$). In this manner, the bottom wall 121 of the cavity 141, i.e., vibration plate 121, and the corresponding segment electrode 122 form (structures) opposed electrodes (capacitor's opposed electrode) through the insulation layer 123 formed on the bottom wall 121 of the cavity 141 at a lower surface in FIG. 3 and the air gap in the recess 161. Accordingly, the major part of the electrostatic actuator 120 is constituted by the vibration plate 121, the segment electrode 122, and the insulation layer 123 and the air gap between them.

As shown in FIG. 3, the head driver 33, including the drive circuit 18 for applying drive voltages between the opposed electrodes, makes charging and discharging between the opposed electrodes according to a printing signal (printing data) inputted from the control section 6. The head driver (voltage applying means) 33 has one output terminal connected to the individual segment electrode 122 and the other output terminal connected to an input terminal 124*a* of the common electrode 124 formed on the silicon substrate 140. Incidentally, because the silicon substrate 140 is implanted with an impurity and possesses conductivity by itself, voltage can be supplied from the input terminal 124*a* of the common electrode 124 to the common electrode 124 on the bottom wall 121. Meanwhile, a thin film of a conductive material, such as gold or copper, may be formed on one surface of the silicon substrate 140. Due to this, a voltage (charge) can be applied at low electric resistance (efficiently) to the common electrode 124. The thin film may be formed by evaporation, sputtering or the like. Herein, the present embodiment, because the bond (joint) between the silicon substrate 140 and the glass substrate 160 by anode bonding, is formed with a conductor film to be used as an electrode in the anode bonded to a surface of the silicon substrate 140 on a side forming a flow passage (upper side of the silicon substrate 140 shown in FIG. 3). The conductor film, as it is, is used as the input terminal 124*a* of the common electrode 124. Incidentally, in the invention, the input terminal 124*a* of the common electrode 124 for example may be omitted and bonding between the silicon substrate 140 and the glass substrate 160 is not limited to anode bonding.

As shown in FIG. 4, the head unit 35 has the nozzle plate 150 formed with the plurality of nozzles 110 corresponding to the plurality of ink jet heads 100; the silicon substrate (ink chamber substrate) 140 formed with the plurality of cavities 141, the plurality of ink supply ports 142, and one reservoir 143; and the insulation layer 123. These are accommodated in a base body 170 including the glass substrate 160. The base body 170 is structured of a resin material of various kinds, a metal material of various kinds or the like. The silicon substrate 140 is fixed and supported on the base body 170.

Incidentally, the plurality of nozzles 110 formed in the nozzle plate 150 are arranged straight and nearly in parallel with the reservoir 143, in order to show the structure with simplicity in FIG. 4. However, the arrangement pattern of nozzles 110 is not limited to this configuration, but usually is arranged with a step deviation as in the nozzle arrangement pattern shown in FIG. 5. Meanwhile, the pitch between the nozzles 110 can be suitably set in accordance with printing resolution (dpi). Incidentally, FIG. 5 shows an arrangement pattern of nozzles 110 in the case of four colors of ink (the ink cartridges 31).

Figure 6C:
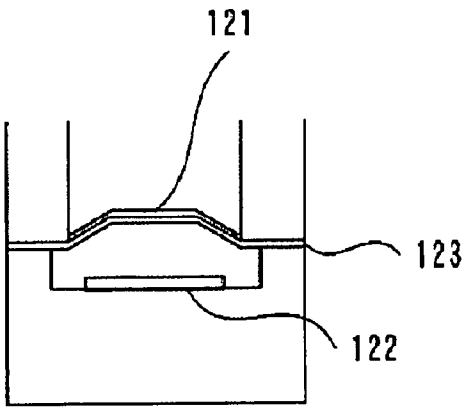
FIGS. 6A–6C are status figures showing the statuses in section III—III of FIG. 3 during drive signal input.
Figure 6B:
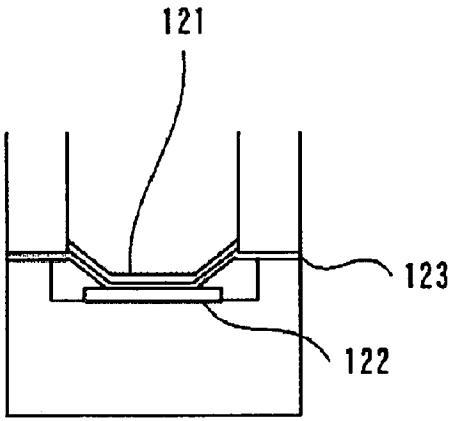
Figure 6A:
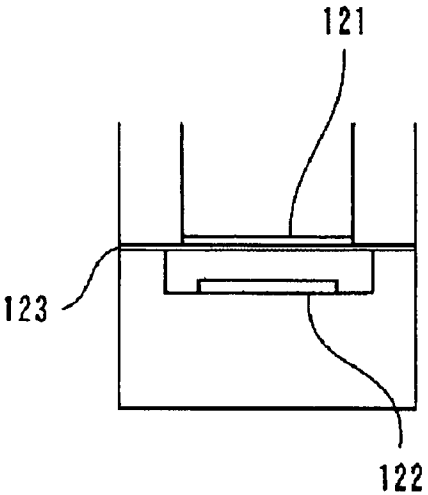

FIG. 6 shows a state in section III—III of FIG. 3 while inputting a drive signal. When a drive voltage is applied from the head driver 33 between opposed electrodes, a Coulomb force occurs between the opposed electrodes. The bottom wall (vibration plate) 121 deflects toward the segment electrode 122 compared with its initial state (FIG. 6(*a*)), to expand the bulk of cavity 141 (FIG. 6(*b*)). In this state, in case the charge on the opposed electrodes is discharged rapidly under control of the head driver 33, the vibration plate 121 restores upwardly in the figure by its elastic restoration force and moves up to beyond the initial position of vibration plate 121. Thus, the cavity 141 suddenly contracts in bulk (FIG. 6(*c*)). At this time, part of the ink (liquid material) filled in the cavity 141 is ejected as ink droplets from the ink nozzle 110 communicating with the cavity 141 due to the compression pressure generated in the cavity 141.

The vibration plate 121 of the cavity 141 is in damped vibration before the next drive signal (drive voltage) is inputted to again eject ink droplets by the series of operations (ink ejecting operation on the drive signal by the head driver 33). Hereinafter, the damped vibration is also referred to as residual vibration. The residual vibration on the vibration plate 121 presumably has an eigen-vibratory frequency determined by an acoustic resistance r due to the shape of the nozzle 110 and ink supply port 142, or ink viscosity and the like, an inertance m (inertness) due to the ink weight in the flow passage, and a compliance Cm of the vibration plate 121.

Figure 7:
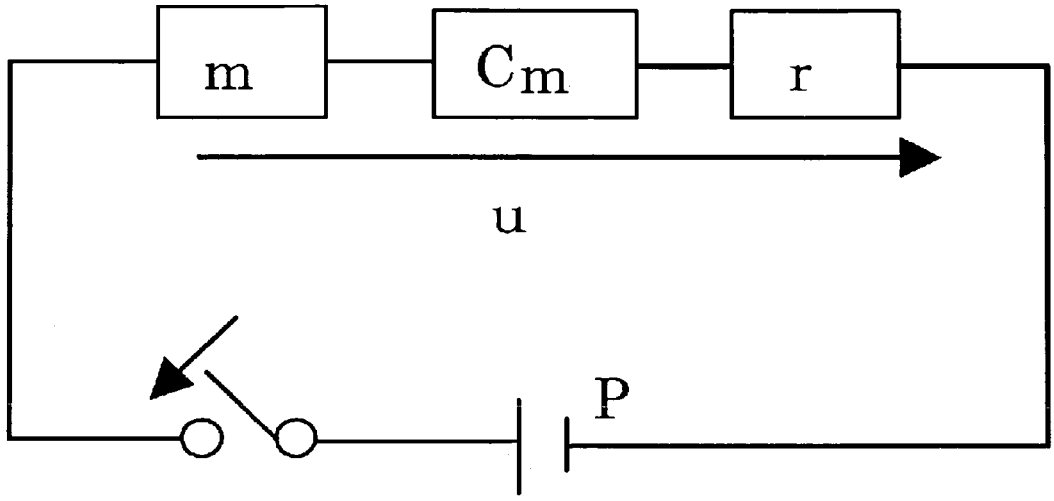
FIG. 7 is a circuit diagram showing a computation model of simple harmonic oscillation based on the assumption of the residual vibration on the vibration plate of FIG. 3.

An explanation is now made regarding the computation model for a residual vibration on the vibration plate 121, based on the above assumption. FIG. 7 is a circuit diagram showing a computation model of a simple harmonic vibration wherein the residual vibration is assumed on the vibration plate 121. In this manner, the computation model of the residual vibration on the vibration plate 121 can be represented by acoustic pressure P, inertance m, compliance Cm, and acoustic resistance r, noted above. In case computing, on a volume velocity u, a step response upon delivering an acoustic pressure P to the circuit of FIG. 7, the following equation is obtained.

Equation 1

$$u = \frac{P}{\omega \cdot m} e^{-\omega t} \cdot \sin \omega t \tag{1}$$

$$\omega = \sqrt{\frac{1}{m \cdot C_m} - \alpha^2} \tag{2}$$

$$\alpha = \frac{r}{2m} \tag{3}$$

Figure 8:
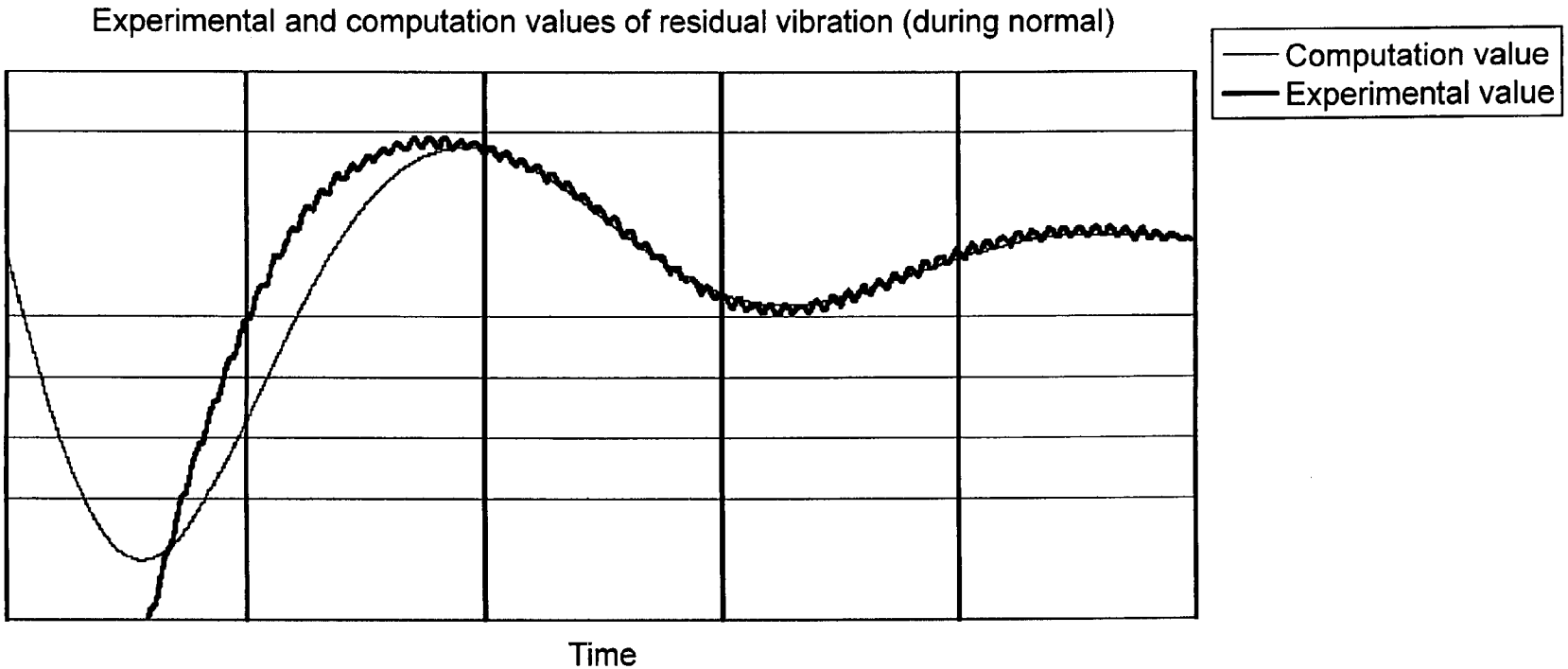
FIG. 8 is a graph showing a relationship between an experimental value and a computation value of residual vibration on the vibration plate of FIG. 3.

A comparison is now made between the computation result obtained from the equation and the experimental result of an experiment separately done on the residual vibration on the vibration plate 121 after ink ejection. FIG. 8 is a graph showing a relationship between an experimental value of residual vibration on the vibration plate 121 and a computation value. As can be seen from the graph of FIG. 8, the two waveforms of experimental and computation values are nearly in agreement.

In the meantime, on the ink jet head 100 of the head unit 35, there is possibly a phenomenon that, despite an ejecting operation as noted above has been done, ink droplets are not normally ejected from the nozzle 110, i.e., an occurrence of a droplet ejection abnormality. The cause of such ejection abnormality occurrence includes (1) an air bubble mixed in the cavity 141, (2) dried/thickened (adhered) ink at or around the nozzle 110, (3) adhered paper powder at the vicinity of the nozzle 110 exit, described later, and so on.

In case such ejection abnormality occurs, there typically appears no ejection of droplets at the nozzle 110, i.e., a non-ejection phenomenon of droplets, as a result thereof. In such a case, there is "dot missing" of the pixels on an image printed (rendered) on the recording paper P. Meanwhile, in the case of ejection abnormality, even if droplets are ejected from the nozzle 110, those droplets do not suitably arrive because of an insufficient amount of droplets or a deviated direction of the droplets (trajectory), still resulting in dot missing. From such fact, droplet ejection abnormality may be merely described "dot missing" in the ensuing explanation.

In the following, the acoustic resistance r and/or the inertance m are adjusted in value on the basis of the comparison result shown in FIG. 8 such that the computation and experimental values of residual vibration on the vibration plate 121 are matched (nearly in agreement) for each cause of the dot missing (ejection abnormality) phenomenon (ink non-ejection phenomenon) caused during print processing at the nozzle 110 of the ink jet head 100. Note that consideration herein is made regarding three kinds of causes, i.e., mixed air bubble, drying/thickening, and adhered paper powder.

Figure 9:
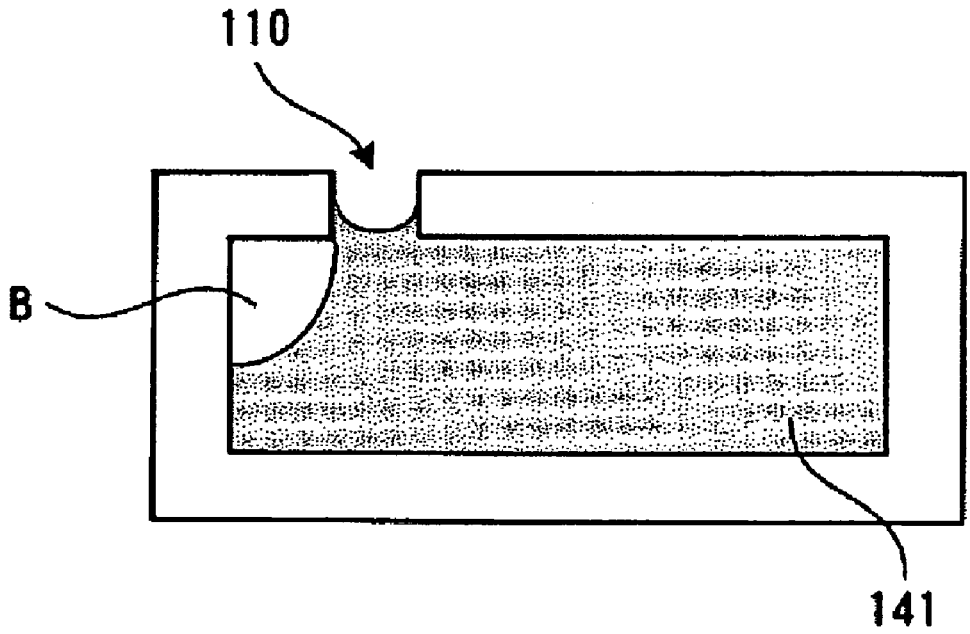
FIG. 9 is a concept figure of a nozzle and vicinity in the case that an air bubble is mixed in the cavity of FIG. 3.

First considered is the mixed bubble in the cavity 141 as one cause of dot missing. FIG. 9 is a concept view at or around the nozzle 110 where an air bubble B is mixed in the cavity 141 shown in FIG. 3. As shown in FIG. 9, the air bubble B is presumed to have been caused and is located on a wall surface of the cavity 141 (in FIG. 9, an example of the position of the air bubble B is shown with the air bubble B at or around the nozzle 110).

In this manner, when the air bubble B is mixed in the cavity 141, there is considered a reduction in the total amount of ink filling the cavity 141, to lower the inertance m. Meanwhile, it can be considered that because the air bubble B is on the wall surface of the cavity 141, there becomes a state that the nozzle 110 is increased in diameter in an amount corresponding to the diameter thereof thus lowering the acoustic resistance r.

Figure 10:
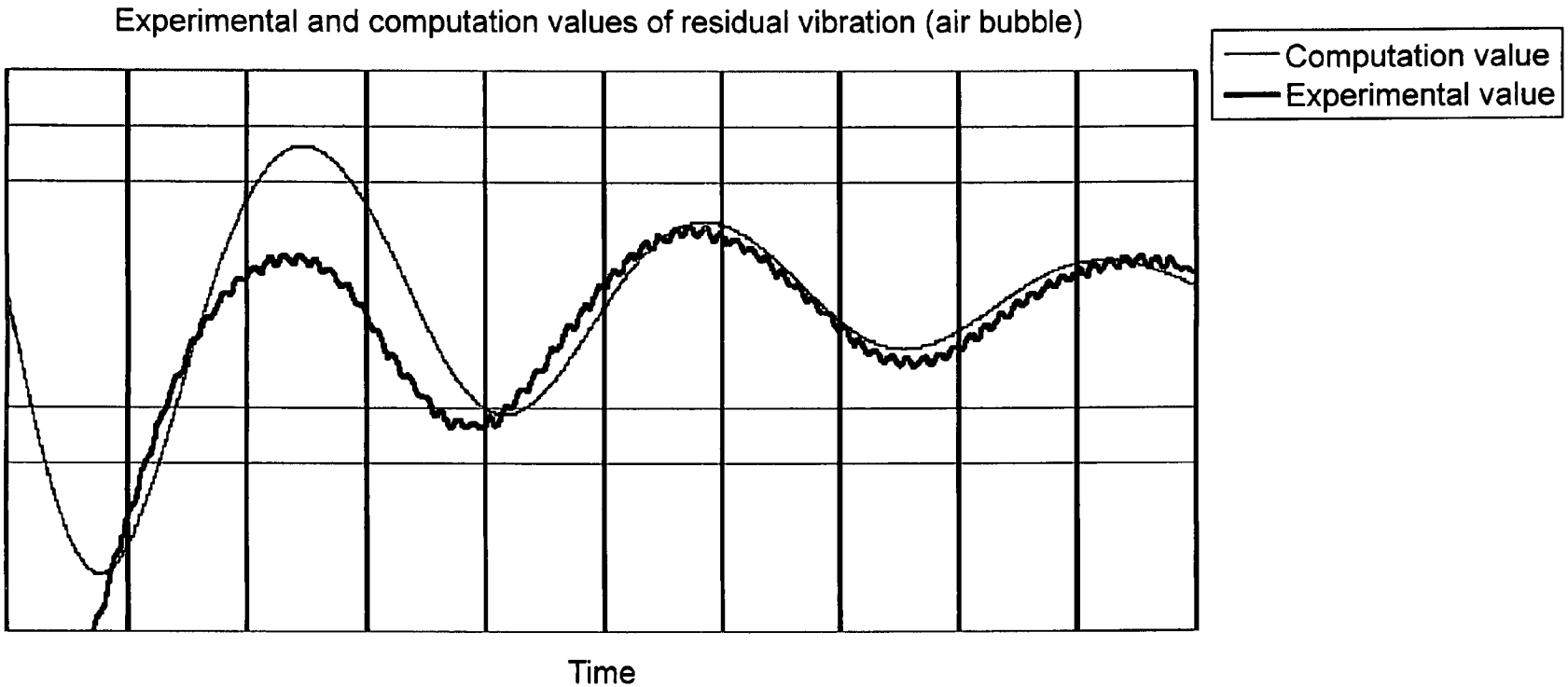
FIG. 10 is a graph showing a computation value and an experimental value of residual vibration in the state when an ink droplet is not to be ejected due to the mixing of an air bubble in the cavity.

Consequently, by setting both the acoustic resistance r and inertance m smaller relative to the FIG. 8 case of normal ink ejection into matching with the experimental value of residual vibration during air bubble mixing, a result (graph) is obtained as shown in FIG. 10. As can be seen from the FIGS. 8 and 10, where an air bubble is mixed in the cavity 141, a characteristic residual vibration waveform is obtained with a frequency that is higher as compared to that during normal ejection. Incidentally, it can be confirmed that the residual vibration is reduced in an amplitude damping factor by the decrease in acoustic resistance r or the like, and the residual vibration reduces its amplitude slowly.

Figure 11:
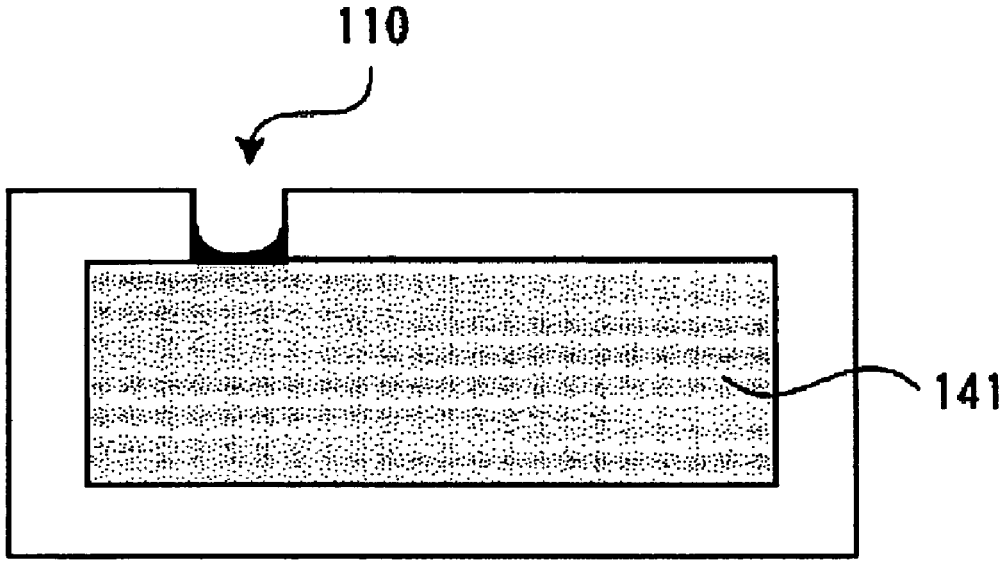
FIG. 11 is a concept figure of a nozzle and vicinity in the case that the ink at or around the nozzle of FIG. 3 is solidified due to drying.

Next considered is dried ink (adhesion, thickening) at or around the nozzle 110 as another cause of dot missing. FIG. 11 is a concept view of the nozzle 110 and its surroundings in the case that the ink nearby the nozzle 110 in FIG. 3 has dried into adhesion. As shown in FIG. 11, when the ink at or around the nozzle 110 dries into adhesion, the ink within the cavity 141 is in a status confined within the cavity 141. In this manner, it can be considered that, where the ink nearby the nozzle 110 is dried and thickened, there is an increase of acoustic resistance r.

Figure 12:
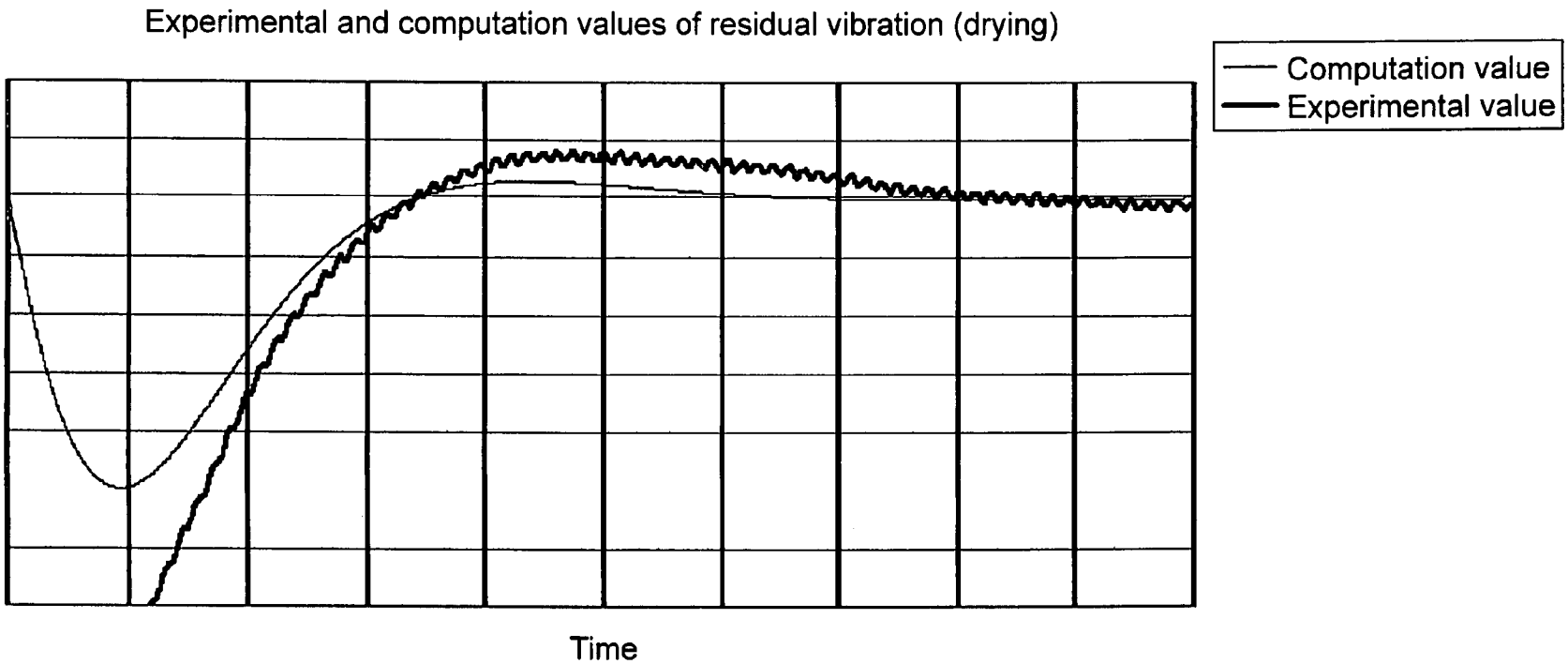
FIG. 12 is a graph showing a computation value and an experimental value of residual vibration in the state when dried/thickened ink is at or around the nozzle.

Accordingly, by setting the acoustic resistance r greater relative to the case of FIG. 8 of normal ink ejection into matching with the experimental value of residual vibration during ink drying/adhesion (thickening) at or around the nozzle 110, a graph as in FIG. 12 is obtained. Incidentally, the experimental values shown in FIG. 12 are for the measurement of residual vibration on the vibration plate 121 after the head unit 35 is allowed to stand without a cap (not shown) for several days to make it impossible to eject ink due to the ink within the cavity 141 drying/thickening at or around the nozzle 110 (ink adhesion). As can be seen from the graph of FIGS. 8 and 12, in the case that the ink at or around the nozzle 110 solidifies due to drying, the frequency is extremely low as compared to that during normal ejection wherein a characteristic residual vibration waveform having excessive damped residual vibration is obtained. This is because, after the ink flows in the cavity 141 from the reservoir 143 due to downward attraction in FIG. 3 of the vibration plate 121 in order to eject ink droplets, there is no escape passage for the ink within the cavity 141 during upward movement of the vibration plate 121 in FIG. 3, thereby not allowing the vibration plate 121 to vibrate rapidly (because of excessive damping).

Figure 13:
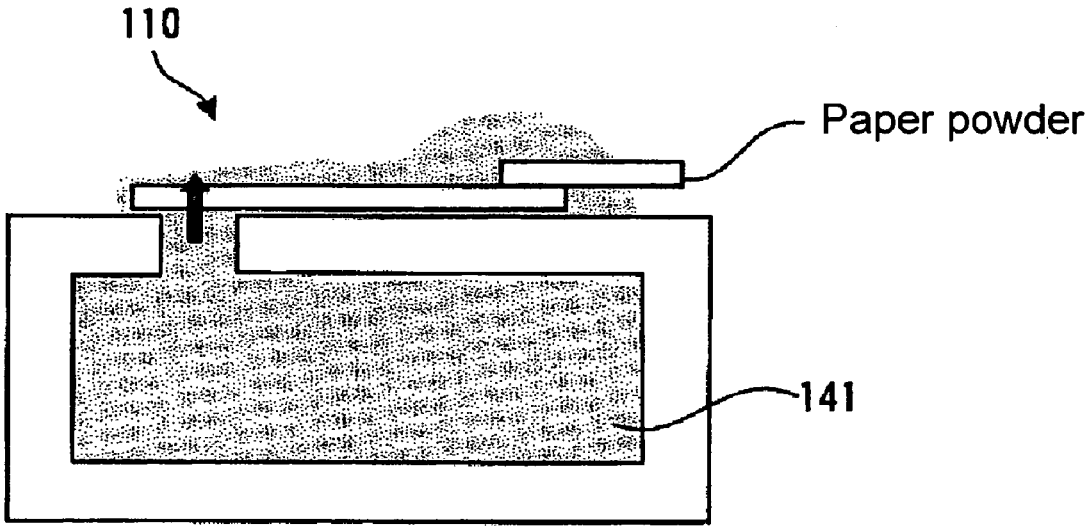
FIG. 13 is a concept figure of a nozzle and vicinity in the case that paper powder is adhered to the vicinity of the nozzle exit of FIG. 3.

Next considered is the paper adhesion near the nozzle 110 as another cause of dot missing. FIG. 13 is a concept view of the nozzle 110 and its vicinity when paper powder is adhered near the nozzle 110 exit of FIG. 3. As shown in FIG. 13, in the case that paper powder is adhered near the exit of nozzle 110, ink possibly soaks out from the inside of the cavity 141 through the paper powder and ink cannot be ejected at the nozzle 110. In this manner, it can be considered that when paper powder is adhered at or around the exit of the nozzle 110 and there is ink soaking out of the nozzle 110, there is an increase of the ink within the cavity 141 and in the amount soaked out rather than under normal conditions, to thereby increase the inertance m for the vibration plate 121. Meanwhile, it is considered that there is an increase in the acoustic resistance r due to the fibers of the paper powder at or around the exit of the nozzle 110.

Figure 14:
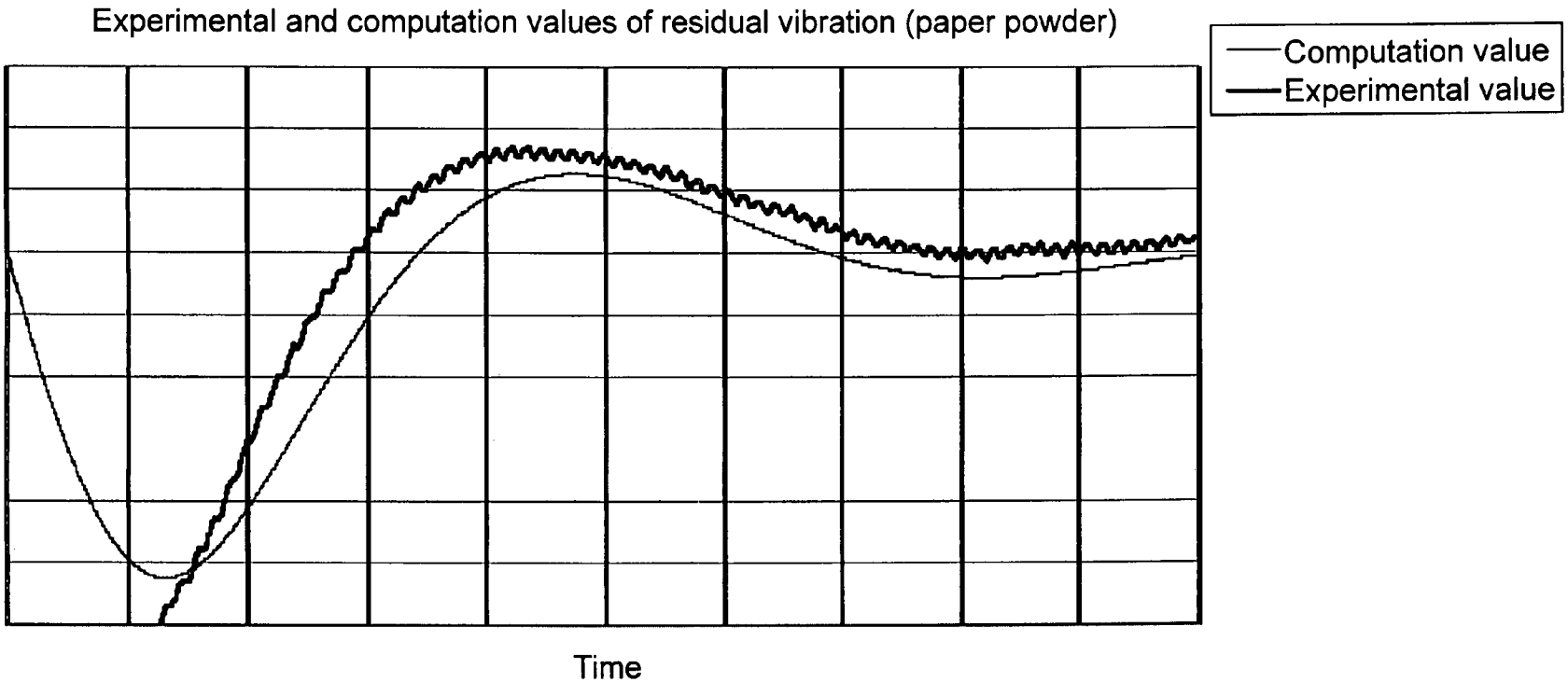
FIG. 14 is a graph showing a computation value and an experimental value of residual vibration in the state when paper powder is adhered to a nozzle exit.
Figure 15B:
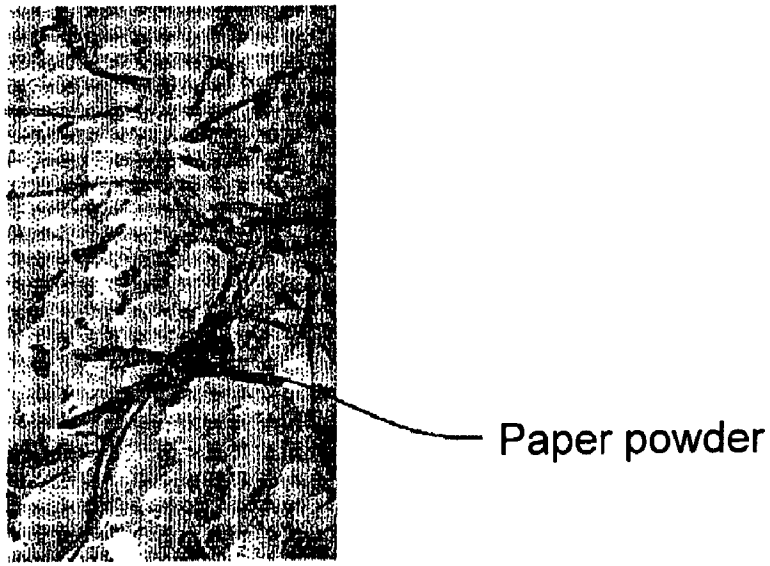
FIG. 15 is a photograph showing a state of the nozzle before and after paper powder is adhered to the vicinity of the nozzle.
Figure 15A:
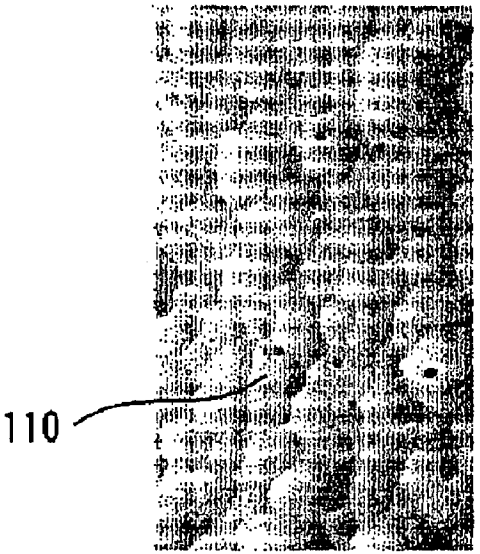

Accordingly, by setting both the inertance m and the acoustic resistance r greater relative to the FIG. 8 case of normal ink ejection into matching with the experimental value of residual vibration during paper adhesion near the exit of the nozzle 110, a result (graph) is obtained as shown in FIG. 14. As can be seen from the graph of FIGS. 8 and 14, where paper powder is adhered near the exit of the nozzle 110, it is possible to obtain a characteristic residual vibration waveform that the frequency is lower as compared to that during normal ejection (herein, it can be seen that, in the case of paper powder adhesion, the residual vibration frequency is higher than the case of dried ink, from the graphs of FIGS. 12 and 14). Incidentally, FIG. 15 is a photograph showing a state of the nozzle 110 before and after paper powder adhesion. It is possible to find out, from FIG. 15B, a state that, if paper powder adheres to a vicinity of the nozzle 110, ink soaks out along the paper powder.

Herein, in both the cases of dried and thickened ink at or around the nozzle 110 and of paper powder adhesion to a vicinity of the exit of the nozzle 110, the damped-vibration frequency is lower as compared to the case of normal ejection of ink droplets. In order to specify the two causes of dot missing (ink non-ejection, ejection abnormality) from the residual vibration waveform on the vibration plate 121, a comparison can be made with a predetermined threshold of frequency, period or phase in the damped vibration. Otherwise, it can be specified from a damping factor in the frequency or amplitude change of the residual vibration (damped vibration). In this manner, it is possible to detect an ejection abnormality on each ink jet head 100 depending upon a residual vibration change on the vibration plate 121 upon ejecting ink droplets from the nozzle 110 of the ink jet head 100, particularly a frequency change thereof. Also, the cause of the ejection abnormality can be specified by comparing the residual vibration frequency in that case with the residual vibration frequency in normal ejection.

Figure 16:
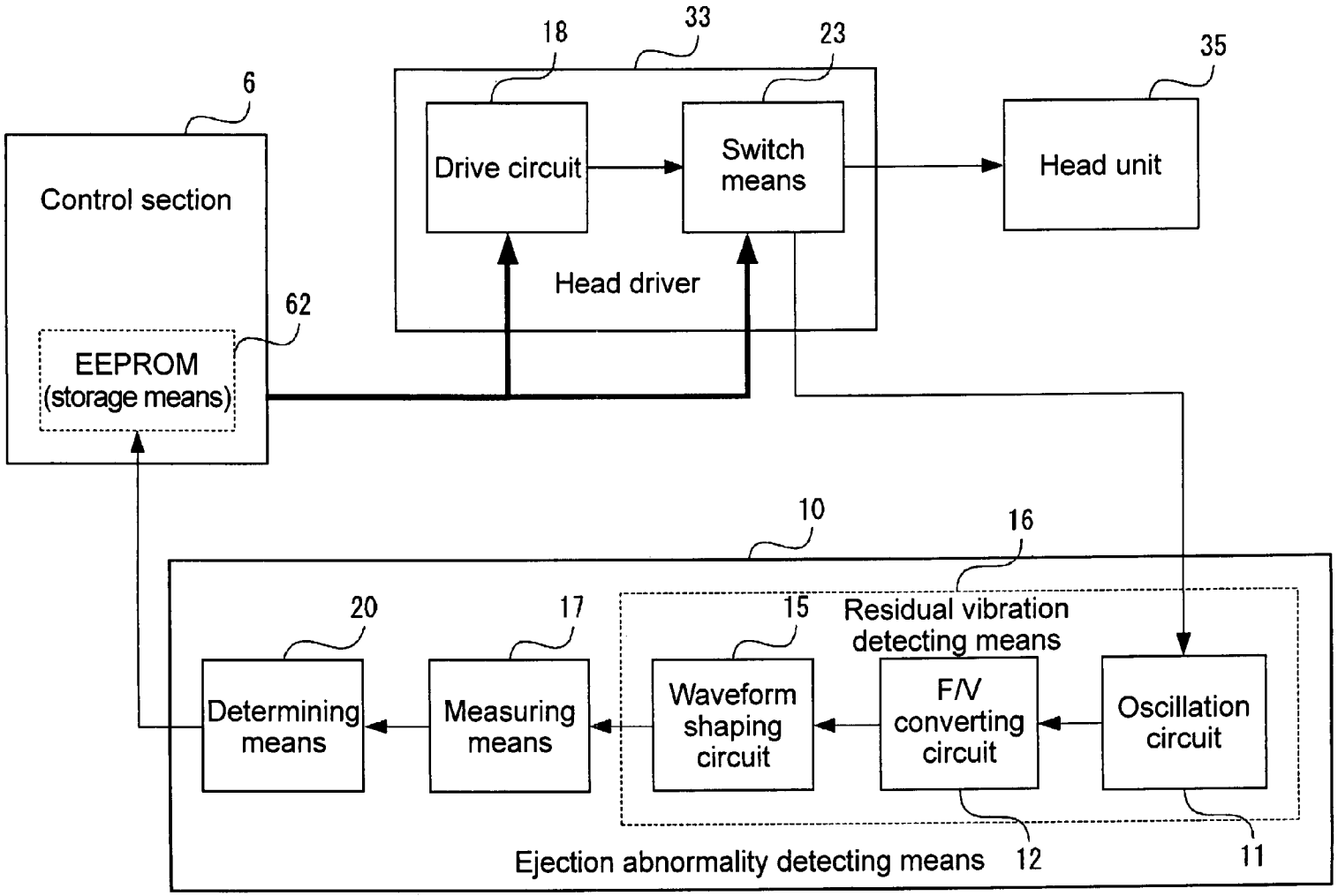
FIG. 16 is a schematic block diagram of the ejection-abnormality detecting device shown in FIG. 3.

Next explained is the ejection-abnormality detecting device 10 of the present invention. FIG. 16 is a schematic block diagram of the ejection-abnormality detecting device 10 shown in FIG. 2. As shown in FIG. 16, the ejection-abnormality detecting device 10 of the present invention has a residual vibration detecting device 16 configured by an oscillation circuit 11, an F/V converting circuit 12, and a waveform-shaping circuit 15, a measuring device 17 for measuring a period or frequency from the residual vibration waveform data detected by the residual vibration detecting device 16, and a determining device 20 for determining an ejection abnormality of the ink jet head 100 depending upon a frequency or the like measured by the measuring device 17. In the ejection-abnormality detecting device 10, the residual vibration detecting device 16 causes the oscillation circuit 11 to oscillate based on the residual vibration on the vibration plate 121 of the electrostatic actuator 120. From this oscillation frequency, a vibration waveform is formed in the F/V converting circuit 12 and waveform-shaping circuit 15, and then detection is carried out. Then, the measuring device 17 measures a frequency and the like of the residual vibration depending upon a detected vibration waveform. The determining device 20 detects and determines an ejection abnormality of the ink jet head 100 or within the head unit 35 depending upon a measured residual vibration period or the like (residual vibration pattern). In the following, the constituent elements of the ejection-abnormality detecting device 10 are described.

Figure 17:
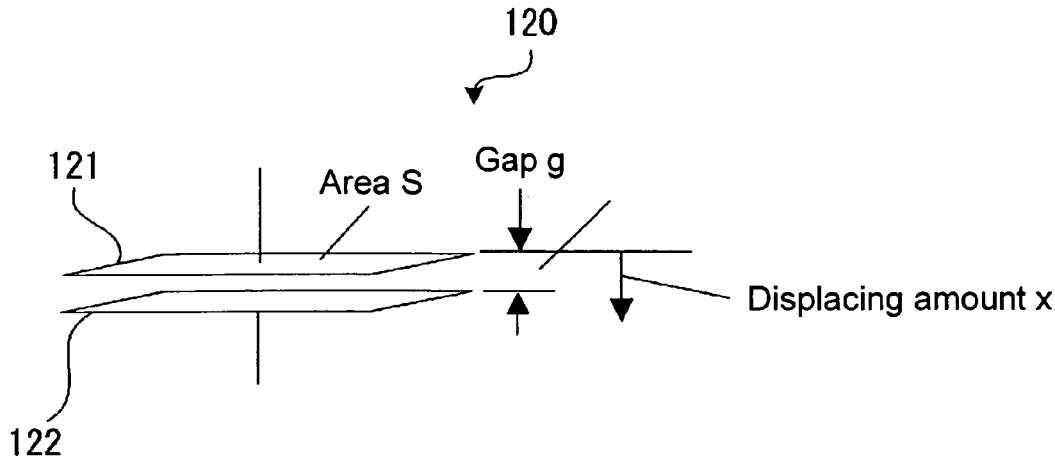
FIG. 17 is a concept figure wherein the electrostatic actuator of FIG. 3 is of a parallel plate capacitor.
Figure 18:
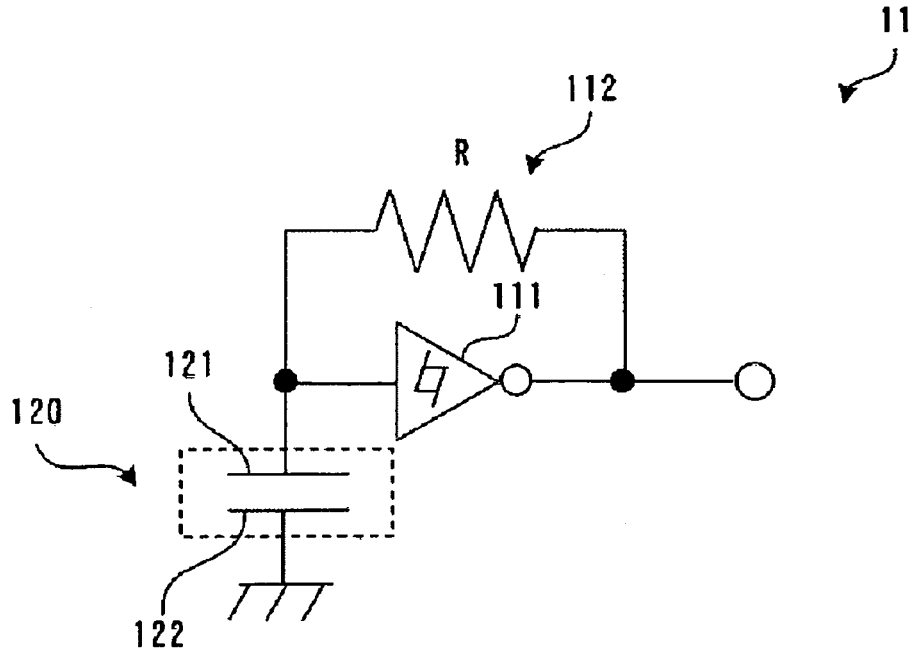
FIG. 18 is a circuit diagram of an oscillation circuit including a capacitor configured by the electrostatic actuator of FIG. 3.

First, explanation is made regarding how to use the oscillation circuit 11 for detecting a residual vibration frequency (vibration frequency) on the vibration plate 121 of the electrostatic actuator 120. FIG. 17 is a concept figure of the electrostatic actuator 120 of FIG. 3 made as a parallel plate capacitor, while FIG. 18 is a circuit diagram of the oscillation circuit 11 including a capacitor configured by the electrostatic actuator 120 of FIG. 3. Note that, although the oscillation circuit 11 shown in FIG. 18 is a CR oscillation circuit utilizing a Schmitt-trigger hysteresis characteristic, the invention is not limited to such a CR oscillation circuit but can use any oscillation circuit provided that using a capacitance component (capacitor C) of an actuator (including a vibration plate). The oscillation circuit 11 may be in a configuration utilizing an LC oscillation circuit, for example. Meanwhile, this embodiment explains with the example using the Schmitt-trigger inverter, a CR oscillation circuit may be configured using three stages of inverters.

In the ink jet head 100 shown in FIG. 3, the electrostatic actuator 120 is structured with opposed electrodes formed by the vibration plate 121 and the segment electrode 122 spaced a very slight distance (gap) therefrom. This electrostatic actuator 120 can be considered as a parallel plate capacitor as shown in FIG. 17. Provided that the capacitor has an electrostatic capacitance C, a surface area S of each of the vibration plate 121 and the segment electrode 12, a distance (gap length) g between the two electrodes 121 and 122, a dielectric constant $\epsilon$ of a space sandwiched between the both electrodes (provided that the dielectric constant in vacuum is $\epsilon_0$ and the dielectric constant in the gap is $\epsilon_r$, then $\epsilon=\epsilon_0 \cdot \epsilon_r$), the capacitance C(x) of the capacitor (electrostatic actuator 120) shown in FIG. 17 can be expressed by the following equation.

Equation 4

$$C(x) = \varepsilon_0 \cdot \varepsilon_r \frac{S}{g - x}(F) \quad (4)$$

Incidentally, x in Equation (4) denotes a displacement amount from a reference position of the vibration plate 121 caused by residual vibration on the vibration plate 121.

As can be seen from Equation (4), the capacitance C(x) increases as the gap length g (gap length g—displacing amount x) decreases while, conversely, the capacitance C(x) decreases as the gap length g (gap length g—displacing amount x) increases. In this manner, the capacitance C(x) is inversely proportional to (gap length g—displacing amount x) (gap length g when x is 0). Note that the electrostatic actuator 120 shown in FIG. 3 has a specific-dielectric constant $\epsilon_r$=1 because the gap is filled with air.

Meanwhile, because the ejected ink droplet (ink dot) is generally made smaller as the resolution is increased for the droplet ejecting apparatus (ink jet printer 1, in this embodiment), the electrostatic actuator 120 is increased in density and smaller in size. This reduces the surface area S of the vibration plate 121 of the ink jet head 100, structuring a smaller electrostatic actuator 120. Furthermore, the gap length g of the electrostatic actuator 120, to be varied by residual vibration due to ink droplet ejection, is nearly 10% of the initial gap $g_0$. Consequently, the capacitance change amount on the electrostatic actuator 120 is a quite small value, as can be seen from Equation (4).

In order to detect a capacitance change amount (different depending upon residual vibration pattern) of the electrostatic actuator 120, the following method is used. Namely, the method is that an oscillation circuit as in FIG. 18 is configured based on the capacitance of the electrostatic actuator 120, to analyze the frequency (period) of residual vibration on the basis of an oscillation signal. The oscillation circuit 11 shown in FIG. 18 is configured by a capacitor (C) constituted by the electrostatic actuator 120, a Schmitt trigger inverter 111, and resistance element (R) 112.

In the case that the output signal of the Schmitt trigger inverter 111 is in a High level, the capacitor C is charged through the resistance element 112. When the charge voltage (potential difference between the vibration plate 121 and the segment electrode 122) to the capacitor C reaches an input threshold voltage $V_{T^+}$ of the Schmitt trigger inverter 111, the output signal of the Schmitt trigger inverter 111 inverts into a Low level. In case the output signal of the Schmitt trigger inverter 111 becomes a Low level, the charge on the capacitor C charged through the resistance element 112 is discharged. When the voltage of the capacitor C reaches an input threshold voltage $V_{T^-}$ of the Schmitt trigger inverter 111 due to the discharge, the output signal of the Schmitt trigger inverter 111 again inverts into a High level. From then on, these oscillation operations are repeated.

Herein, in order to detect a capacitance change in time of the capacitor C in each of the phenomena (mixed air bubble, drying, adhered paper powder, and normal ejection), there is a need for setting the oscillation frequency of the oscillation circuit 11 that can detect a frequency during air bubble mixing (see FIG. 10) highest in residual vibration frequency. For this reason, the oscillation frequency on the oscillation circuit 11 must be given several times to several tens times the residual vibration frequency to be detected, i.e., higher by one or more figures than the frequency in bubble mixing. In this case, preferably, because the residual vibration frequency in bubble mixing shows higher frequency as compared to the case of normal ejection, the setting is at an oscillation frequency for detecting the residual vibration frequency in bubble mixing. If not, it is impossible to detect a correct residual vibration frequency of an ejection abnormality phenomenon. Consequently, in the present embodiment, a CR time constant on the oscillation circuit 11 is set depending upon the oscillation frequency. In this manner, by setting the oscillation frequency of the oscillation circuit 11 high, it is possible to detect a more correct residual vibration waveform depending upon a slight change in this oscillation frequency.

Incidentally, by using a measuring count pulse (counter) on each period (pulse) of the oscillation frequency of the oscillation signal outputted from the oscillation circuit 11 to thereby count the pulse, and subtracting from a measured count amount a pulse count on an oscillation frequency in the case of oscillation with a capacitance of the capacitor C having the initial gap $g_0$, digital information is obtained at each oscillation frequency on the residual vibration waveform. By carrying out digital/analog (D/A) conversion based on the digital information, a schematic residual vibration waveform can be produced. Although such a method may be used, the measuring count pulse (counter) requires one having high frequency (high resolution) capable of measuring a slight change of oscillation frequency. Because such a count pulse (counter) is cost-mounting, the ejection-abnormality detecting device 10 uses an F/V converting circuit 12 shown in FIG. 19.

Figure 19:
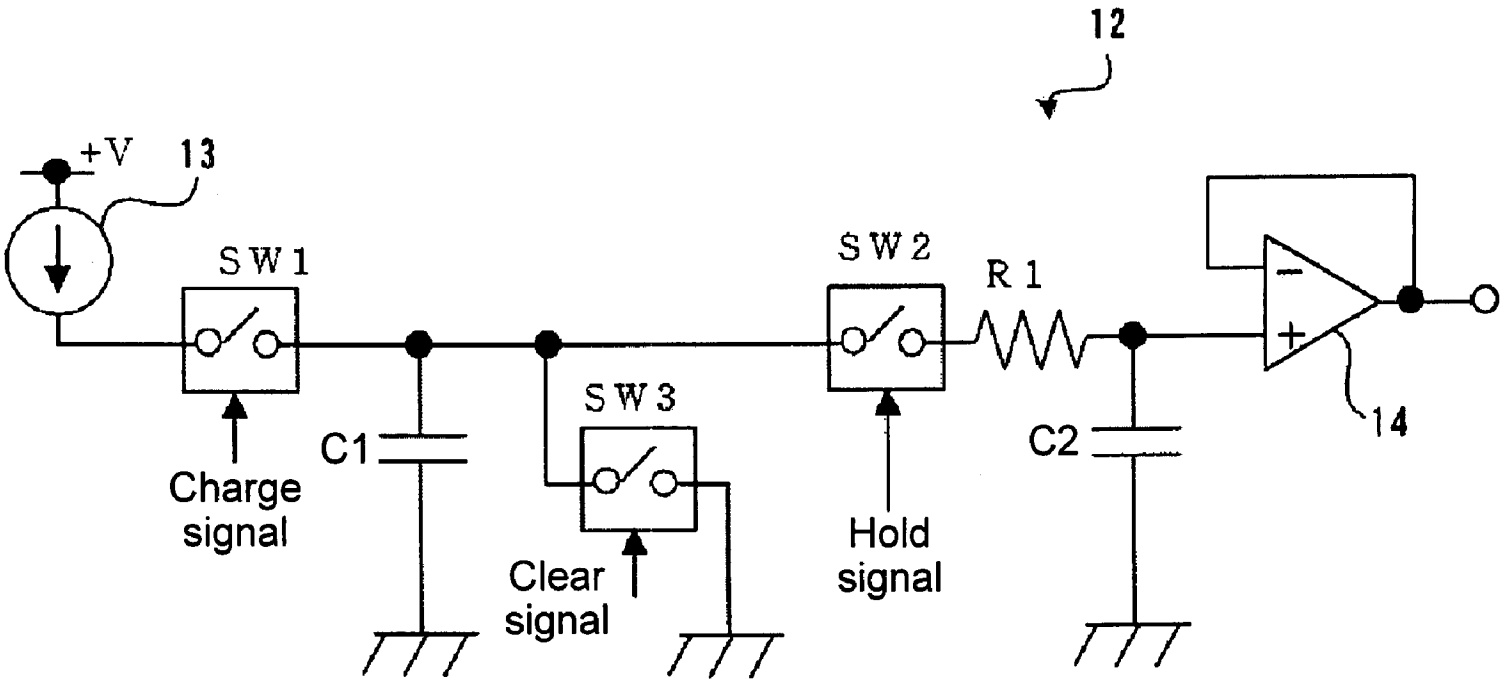
FIG. 19 is a circuit diagram of an F/V conversion circuit of the ejection-abnormality detecting device shown in FIG. 16.

FIG. 19 is a circuit diagram of the F/V converting circuit 12 of the ejection-abnormality detecting device 10 shown in FIG. 16. As shown in FIG. 19, the F/V converting circuit 12 is configured by three switches SW1, SW2, and SW3; two capacitors C1 and C2; a resistance element R1; a constant-current source 13 for outputting a constant current Is; and a buffer 14. The operation of the F/V converting circuit 12 is explained by using the timing chart of FIG. 20 and the graph of FIG. 21.

Figure 20:
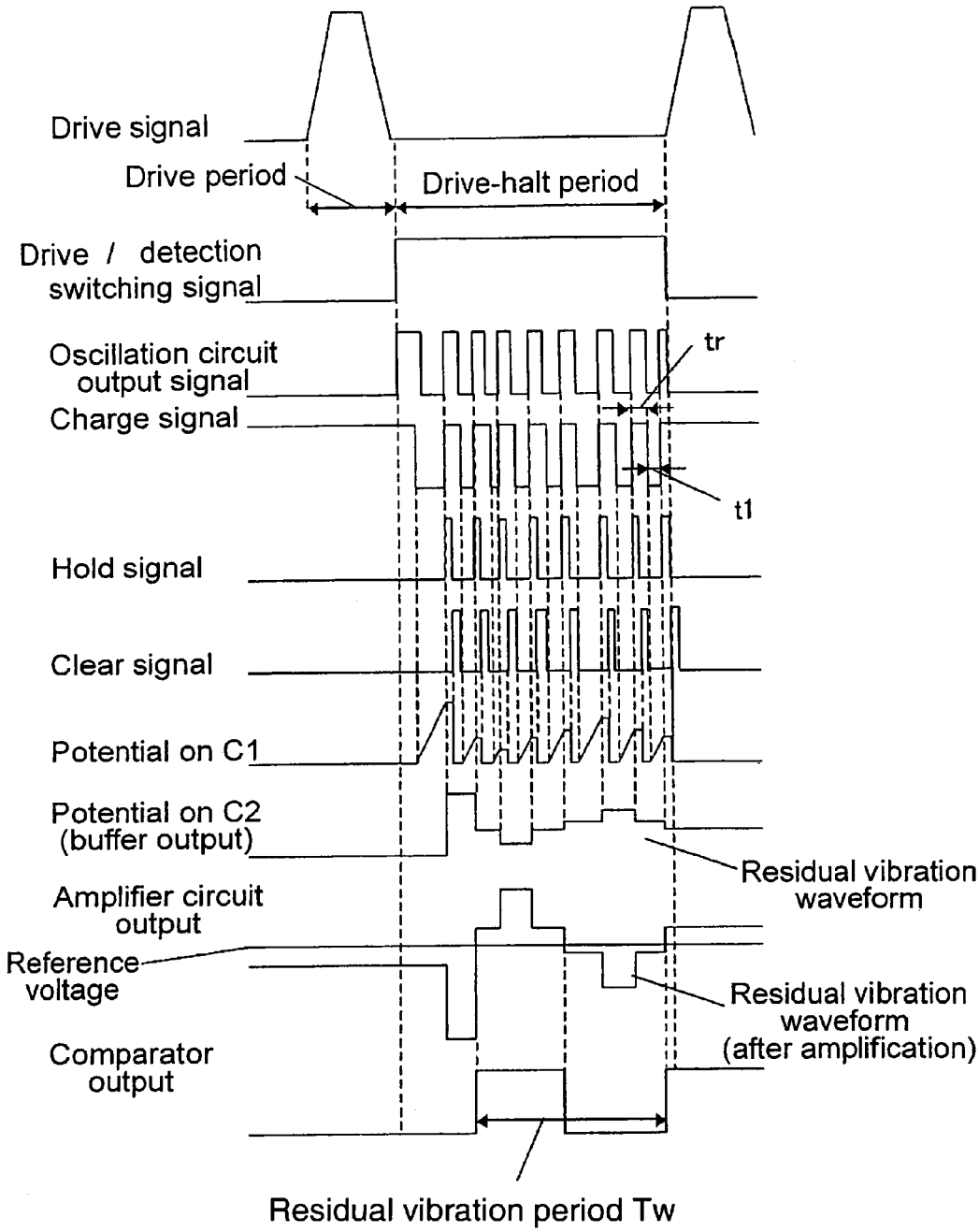
FIG. 20 is a timing chart showing the timing of output signals of the sections, based on an oscillation frequency outputted from the oscillation circuit of the present invention.

First, explanation is made regarding the method for generating a charge signal, a hold signal, and a clear signal shown in the timing chart of FIG. 20. The charge signal can be generated such that it is set with a fixed time tr at a rising edge of an oscillation pulse of the oscillation circuit 11 and rendered in a High level for the fixed time tr. The hold signal is generated such that it rises synchronously with a rising edge of the charge signal and held in a High level for a predetermined fixed time and falls to a Low level. The clear signal is generated such that it rises synchronously with a falling edge of the hold signal and held in a High level for a predetermined fixed time and falls to a Low level. Incidentally, as hereinafter described, because the charge movement from the capacitor C1 to capacitor C2 and the discharge from the capacitor C1 are instantaneously done, the hold signal and the clear signal may respectively have one pulse before a next rise in the output signal of the oscillation circuit 11, and thus not limited to the rising and falling edges as above.

Figure 21:
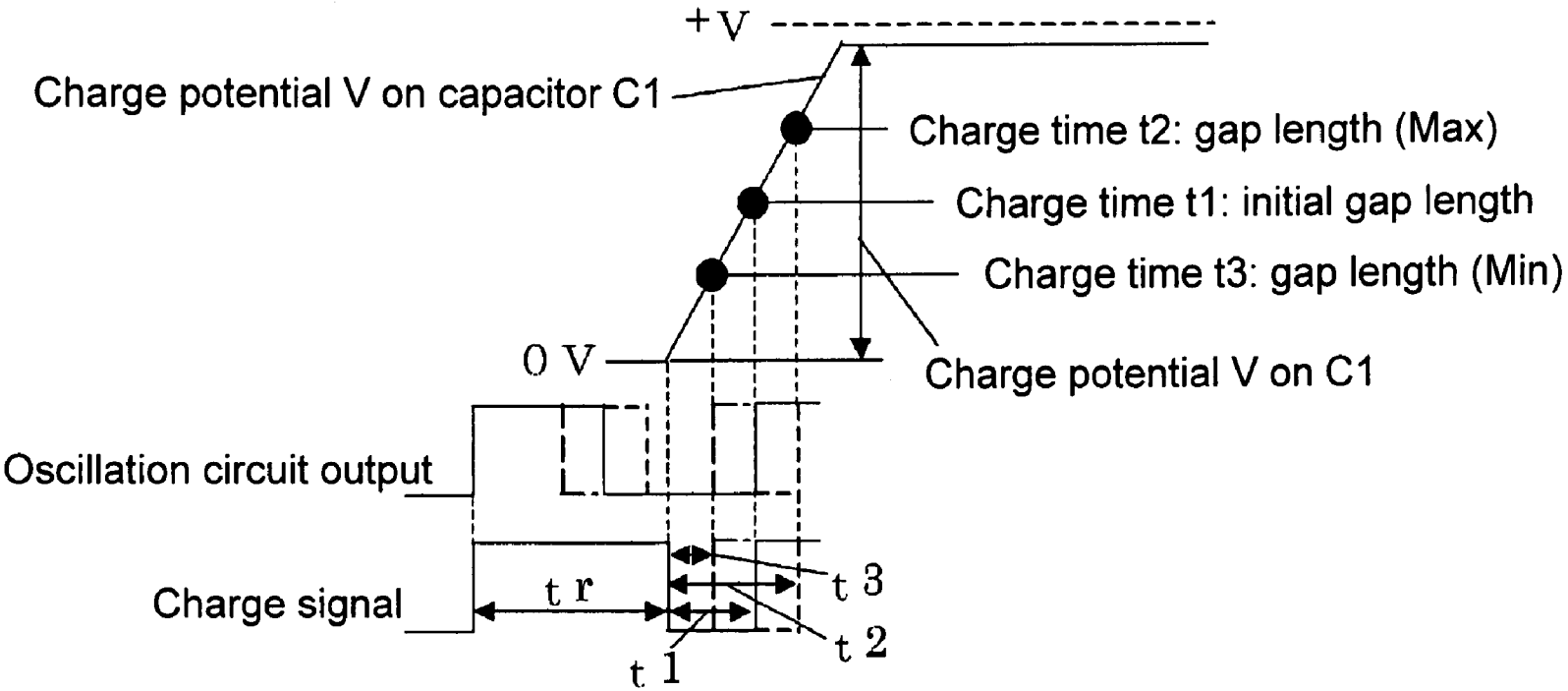
FIG. 21 is a figure for explaining how to set a fixed time tr and t1.

In order to obtain a clear-cut waveform of residual vibration (voltage waveform), explanation is made regarding how to set a fixed time tr and t1 with reference to FIG. 21. The fixed time tr is adjusted from the period of an oscillation pulse oscillating at a capacitance C with the initial gap length go of the electrostatic actuator 120, and set such that the charge potential by the charge time t1 is nearly ½ of a charge range of C1. Meanwhile, the inclination of charge potential is set not to exceed the charge range of the capacitor C1, in between the charge time t2 the gap length g is maximum and the charge time t3 it is minimum. Namely, because the inclination of charge potential is determined by dV/dt=Is/C1, the output constant current Is of the constant current source 13 may be set at a proper value. By setting the output constant current Is of the constant current source 13 possibly high within the range; it is possible to detect, with sensitivity, a slight capacitance change of the capacitor constituted by the electrostatic actuator 120. Thus, it is possible to detect a slight change of the vibration plate 121 of the electrostatic actuator 120.

Figure 22:
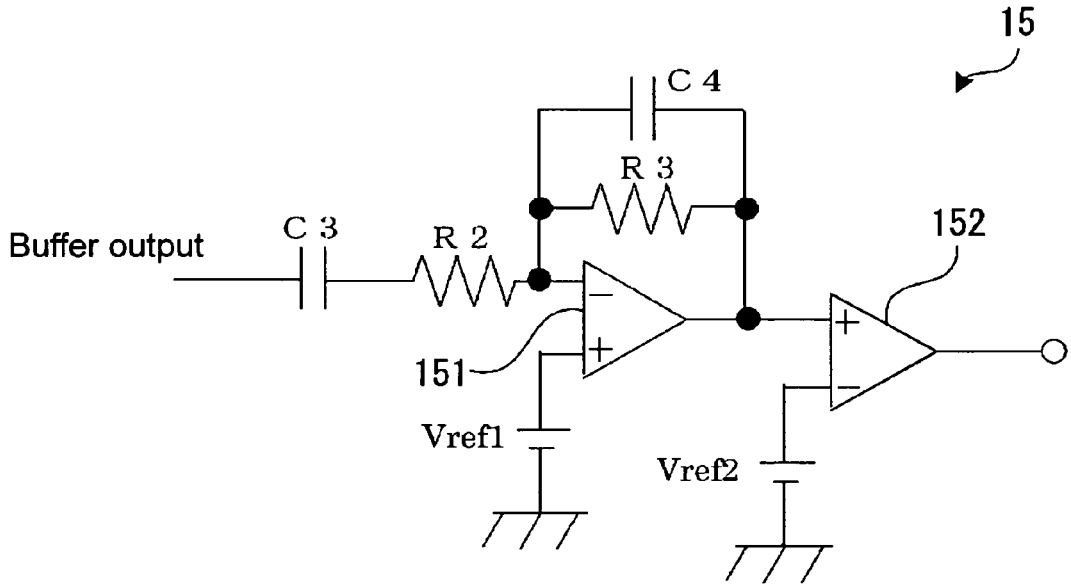
FIG. 22 is a circuit diagram showing a circuit configuration of the waveform shaping circuit of FIG. 16.

Now, explanation is made regarding the configuration of a waveform shaping circuit 15 shown in FIG. 16, with reference to FIG. 22. FIG. 22 is a circuit diagram showing a circuit configuration of the waveform shaping circuit 15 shown in FIG. 16. This waveform shaping circuit 15 is to output a residual vibration waveform as a rectangular wave to the determining device 20. As shown in FIG. 22, the waveform shaping circuit 15 is configured with two capacitors C3 (DC component removing means) and C4; two resistance elements R2 and R3; two direct-current voltage sources Vref1 and Vref2; an amplifier (operational amplifier) 151; and a comparator 152. Incidentally, configuration may be made to output, as it is, a wave height value detected in a waveform shaping process on the residual vibration waveform, thereby measuring the amplitude of the residual vibration waveform.

The buffer 14 of the F/V converting circuit 12 has an output containing a capacitance component of a DC component (direct-current component) based on the initial gap go of the electrostatic actuator 120. Because the direct-current component varies between the ink jet heads 100, the capacitor C3 removes the capacitance direct-current component. The capacitor C3 removes a DC component in the output signal of the buffer 14, and outputs only an AC component of residual vibration to an inverted input terminal of the operational amplifier 151.

The operational amplifier 151 inverts and amplifies an output signal of the buffer 14 of the F/V converting circuit 12 removed of the direct-current component, and configures a low pass filter for removing the higher band of the output signal. Incidentally, this operational amplifier 151 is assumed to be a single power source circuit. The operational amplifier 151 configures an inverting amplifier with two resistance elements R2 and R3, to amplify an inputted residual vibration (alternating current component) −R3/R2 times.

Meanwhile, because of the single power source operation of the operational amplifier 151, an amplified residual vibration waveform of the vibration plate 121 vibrating about a potential set by the direct-current voltage source Vref1 connected to the non-inverted input terminal thereof is output. Herein, the direct-current voltage source Vref1 is set at about half of the voltage range the operational amplifier 151 and is operable on a single power source. Furthermore, this operational amplifier 151 configures a low pass filter having a cut-off frequency $1/(2\pi \times C4 \times R3)$ based on two capacitors C3 and C4. The residual vibration waveform of the vibration plate 121 amplified after removing a direct-current component, in the next-staged comparator 15, is compared with a potential of another direct-current voltage source Vref2, as shown in the timing chart of FIG. 20. The comparison result is outputted as a rectangular wave from the waveform shaping circuit 15. Incidentally, the direct-current voltage source Vref2 may also use the other direct-current voltage source Vref1.

Referring next to the timing chart shown in FIG. 20, explanation is made regarding the operation of the F/V converting circuit 12 of FIG. 19 and waveform shaping circuit 15. The F/V converting circuit 12 shown in FIG. 19 operates on the basis of the charge signal, clear signal, and hold signal generated as in the above. In the timing chart of FIG. 20, when a drive signal to the electrostatic actuator 120 is inputted to the ink jet head 100 of the head unit 35 through the head driver 33, the vibration plate 121 of the electrostatic actuator 120 is attracted toward the segment electrode 122 as shown in FIG. 6(*b*) and rapidly contracts upwardly in FIG. 6 synchronously with a falling edge of the drive signal (see FIG. 6(*c*)).

In synchronism with the falling edge of the drive signal, the drive/detection switching signal for switching over between the drive circuit 18 and the ejection-abnormality detecting device 10 becomes a High level. This drive/detection switching signal, in a drive-halt period of the corresponding ink jet head 100, is held in a High level and becomes a Low level before the next drive signal is inputted. During High level of the drive/detection switching signal, the oscillation circuit 11 of FIG. 18 is in oscillation while changing its oscillation frequency corresponding to the residual vibration on the vibration plate 121 of the electrostatic actuator 120.

The charge signal is held at a High level until the lapse of a fixed time tr previously set, such that the residual vibration waveform does not exceed a chargeable range to the capacitor C1, at the falling edge of the drive signal, i.e., a rising edge of the output signal of the oscillation circuit 11. Incidentally, while the charge signal is at a High level, the switch SW1 is in an off state.

When the fixed time tr elapses and the charge signal becomes a Low level, the switch SW1 is turned on synchronously with a falling edge of the charge signal (see FIG. 19). Then, the constant-current source 13 and the capacitor C1 are connected together, and the capacitor C1 is charged with an inclination Is/C1 as noted above. The capacitor C1 is being charged in the time period the charge signal is at a Low level, i.e., in the duration before assuming a High level synchronously with a rising edge of the next pulse of the output signal of the oscillation circuit 11.

When the charge signal becomes a High level, the switch SW1 turns off (open), and the constant-current source 13 and the capacitor C1 are placed out of connection. Thereupon, the capacitor C1 is conserved with a potential charged during a Low level time period t1 of the charge signal (i.e., ideally Is×t1/C1(V)). In this state, when the hold signal becomes a High level, the switch SW2 turns on (see FIG. 19), to connect between the capacitor C1 and the capacitor C2 through the resistance element R1. After connecting the switch SW2, charging and discharging is mutually made by the charge potential difference between the two capacitors, C1 and C2. Charge is moved from the capacitor C1 to the capacitor C2 such that the potential difference between the two capacitors, C1 and C2, become nearly the same.

Herein, the capacitance of the capacitor C2 is set approximately one-tenth or lower relative to the capacitance of the capacitor C1. Consequently, the amount of the charge, to be moved (used) upon charging and discharging caused by a potential difference between the two capacitors, C1 and C2, is one-tenth or lower of the charge stored on the capacitor C1. Accordingly, even after charge movement from the capacitor C1 to the capacitor C2, the potential difference on the capacitance in the capacitor C1 is not greatly changed (not greatly lowered). Incidentally, in the FN circuit 12 of FIG. 19, a primary low pass filter is configured by a resistance element R1 and a capacitor C2 in order not to cause an abrupt rise of charge potential due to the inductance of the wiring of the F/V converting circuit 12 when the capacitor C2 is charged.

After a charge potential nearly equal to the charge potential to the capacitor C1 is held on the capacitor C2, the hold signal becomes a Low level. Thus, the capacitor C1 is placed out of connection with the capacitor C2. Furthermore, by the High level of the clear signal and turning on of the switch SW3, the capacitor C1 is connected to the ground GND, to effect discharging such that the charge stored on the capacitor C1 becomes zero. After the discharge of the capacitor C1, the clear signal becomes a Low level and the switch SW3 turns off to standby until the electrode in the upper part of the capacitor C1 in FIG. 19 is placed out of connection with the ground GND and thereby the next charge signal is inputted.

The potential held on the capacitor C2 is updated each time the charge signal rises, i.e., at each time of completion of charging to the capacitor C2, and outputted as a residual vibration waveform on the vibration plate 121 to the waveform shaping circuit 15 of FIG. 22 through the buffer 14. Consequently, in case the capacitance (in this case, capacitance variation width due to residual vibration must be considered) of the electrostatic actuator 120 and the resistance value of the resistance element 112 are set in a manner increasing the oscillation frequency of the oscillation circuit 11, the potential (output of the buffer 14) step of capacitor C2 shown in the timing chart of FIG. 20 is further detailed, making it possible to detect a change in time of the capacitance due to the residual vibration on the vibration plate 121 in more detail.

Similarly in the subsequent, the charge signal repeatedly assumes Low level→High level→Low level . . . . Thus, the potential held on the capacitor C2 in the predetermined timing is outputted to the waveform shaping circuit 15 through the buffer 14. In the waveform shaping circuit 15, the direct-current component of a voltage signal (potential on the capacitor C2, in the timing chart of FIG. 20) inputted from the buffer 14 is removed by the capacitor C3, and inputted to the inverted input terminal of the operational amplifier 151 through the resistance element R2. The inputted the alternating current (AC) component of residual vibration is inversion-amplified by the operational amplifier 151 and outputted to one input terminal of the comparator 152. The comparator 152 compares between the potential (reference voltage) previously set by the direct-current voltage source Vref2 and the potential of residual vibration waveform (alternating-current component), to output a rectangular wave (output of the comparator circuit in the timing chart of FIG. 20).

Figure 23:
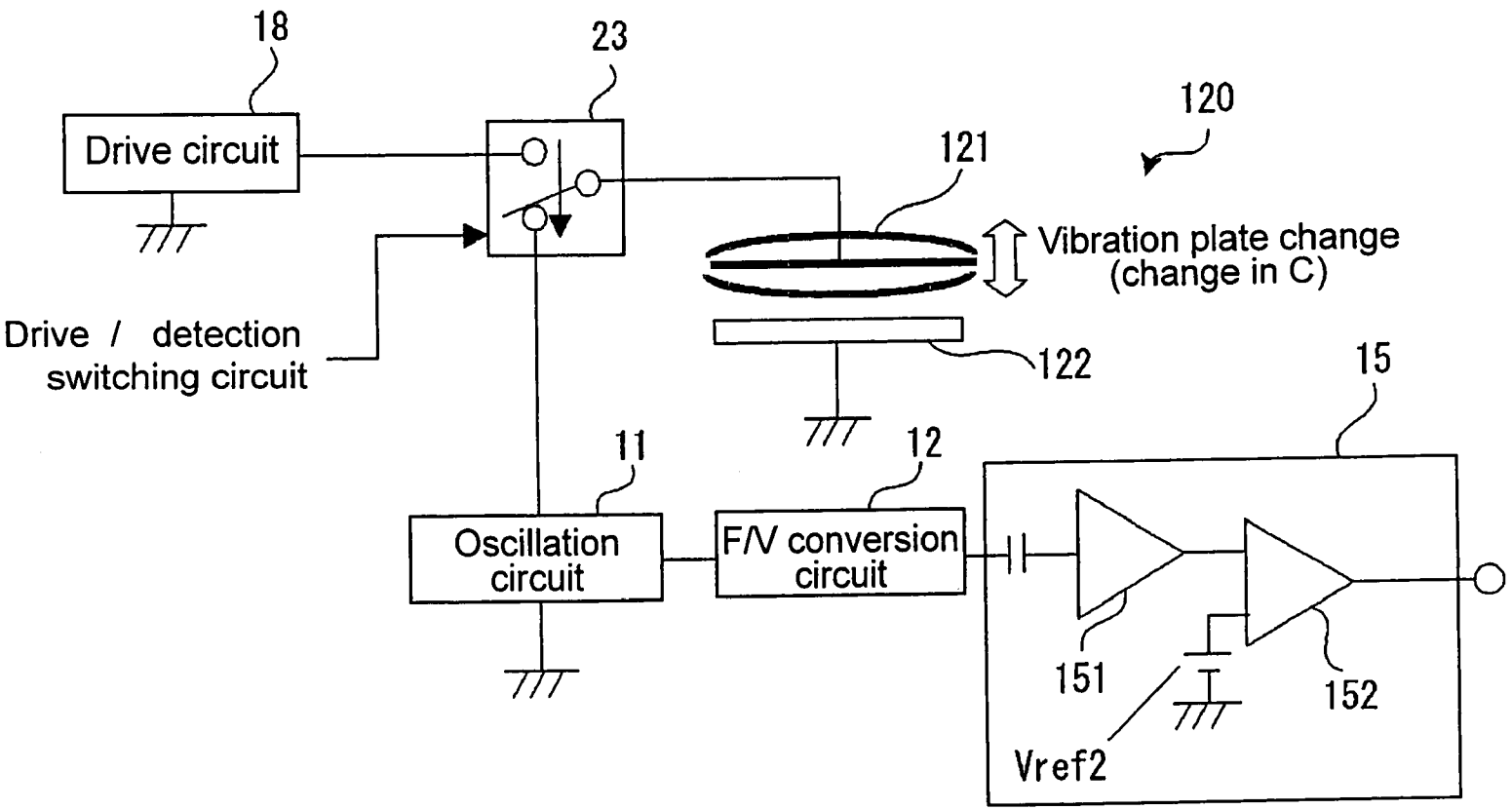
FIG. 23 is a block diagram showing the outline of the switch device between drive and detection circuits.

Now, explanation is made regarding the timing of switching over between ink ejecting operation (drive) and ejection-abnormality detecting operation of the ink jet head 100. FIG. 23 is a block diagram showing the outline of the switch device 23 between the drive circuit 18 and the ejection-abnormality detecting device 10. Incidentally, in FIG. 23, the drive circuit 18 within the head driver 33 shown in FIG. 16 is explained as a drive circuit to the ink jet head 100. As was also shown in the timing chart of FIG. 20, the ejection-abnormality detection process of the present invention is executed between drive signals for the ink jet head 100, i.e., in a drive-halt period.

In FIG. 23, the switch device 23 is first connected to the drive circuit 18 side in order to drive the electrostatic actuator 120. When a drive signal (voltage signal) is inputted from the drive circuit 18 to the vibration plate 121, the electrostatic actuator 120 is driven. Then, the vibration plate 121 is attracted toward the segment electrode 122 and, when the application voltage becomes zero, it rapidly displaces in a direction away from the segment electrode 122 thus starting vibration (residual vibration). Thereupon, an ink droplet is ejected from the nozzle 110 of the ink jet head 100.

When the drive signal pulse falls, a drive/detection switching signal (see the timing chart of FIG. 20) is inputted synchronously with the falling edge thereof to the switch device 23. The switch device 23 is switched from the drive circuit 18 over to the ejection-abnormality detecting device (detecting circuit) 10. The electrostatic actuator 120 (utilized as a capacitor for the oscillation circuit 11) is connected to the ejection-abnormality detecting device 10.

Then, the ejection-abnormality detecting device 10 carries out a detecting process of ejection abnormality (dot missing) as noted before, to digitize the residual vibration waveform data (rectangular wave data) of the vibration plate 121 outputted from the comparator 152 of the waveform shaping circuit 15 into a period or amplitude of residual vibration waveform by the measuring device 17. In the present embodiment, the measuring device 17 measures a particular vibration period from the residual vibration wavefQrm data, and outputs the result of the measuring (numeric value) to the determining device 20.

Specifically, the measuring device 17 counts the pulses of a reference signal (predetermined frequency) by using a counter (not-shown) in order to measure a time of from the first rising edge to the next rising edge on an output signal waveform (rectangular wave) of the comparator 152, and measures a period (particular vibration period) of residual vibration from the count value. Incidentally, the measuring device 17 may measure a time of from the first rising edge to the next falling edge, to output a time double the measured time (i.e., a half period) as a residual vibration period to the determining device 20. Hereinafter, the residual vibration period thus obtained is assumed Tw.

The determining device 20 determines a presence or absence of nozzle ejection abnormality, a cause of ejection abnormality, a comparison deviation value and so on depending upon a particular vibration period (measuring result) or the like measured by the measuring device 17 and outputs the determination result to the control section 6. The control section 6 saves the determination result in a preset storage domain of the EEPROM (storage means) 62. Then, a drive/detection switching signal is again inputted to the switch device 23 in the timing the next drive signal is inputted from the drive circuit 18, to connect the drive circuit 18 and the electrostatic actuator 120 together. The drive circuit 18, because maintaining the ground (GND) level if drive voltage is once applied, makes a switching as in the above by the switch device 23 (see the timing chart of FIG. 20). Due to this, it is possible to correctly detect a residual vibration waveform on the vibration plate 121 of the electrostatic actuator 120 without being affected by the outside disturbance from such as the drive circuit 18.

Incidentally, in the invention, the residual vibration waveform data is not limited to those made in rectangular waves by the comparator 152. For example, the residual vibration amplitude data outputted from the operational amplifier 151 may be digitized at all times by the measuring device 17 for A/D conversion, without making a comparison process by the comparator 152. Depending upon the digitized data, the determining device 20 may determine a presence or absence of an ejection abnormality, to store the determination result in the storage device 62.

Meanwhile, the meniscus (the contact surface of ink in the nozzle 110 with the air) at the nozzle 110 vibrates synchronously with the residual vibration of the vibration plate 121. Accordingly, the ink jet head 100, after ejecting an ink droplet, makes the next ejection after waiting (after standby for a predetermined time) for the attenuation of meniscus residual vibration in a time generally determined by the acoustic resistance r. The present invention can detect an ejection abnormality without effecting the driving of the ink jet head 100, because the residual vibration of the vibration plate 121 is detected by effectively utilizing the standby time. Namely, it is possible to carry out an ejection-abnormality detection process for the nozzle 110 of the ink jet head 100 without lowering the throughput on the ink jet printer 1 (droplet ejecting apparatus).

In the case that an air bubble is mixed in the cavity 141 of the ink jet head 100 as mentioned before, the frequency increases as compared with the residual vibration waveform of the vibration plate 121 in normal ejection, to have a period conversely shorter than the period of residual vibration during normal ejection. Meanwhile, in the case that the ink at or around the nozzle 110 is thickened or adhered due to drying, the residual vibration excessively attenuates; because the frequency is considerably lower as compared to the residual vibration waveform in normal ejection, the period is considerably longer than the period of residual vibration in normal ejection. Meanwhile, in the case that paper powder is adhered at or around an exit of the nozzle 110, the residual vibration has a frequency lower than the residual vibration frequency in normal ejection but higher than the residual vibration frequency in ink drying; consequently, this period is longer than the period of residual vibration in normal ejection but shorter than the period of residual vibration in ink drying.

Accordingly, by providing a predetermined range Tr (upper limit Tru, lower limit Tr1) as a period of residual vibration in normal ejection and setting a predetermined threshold T1 for distinguishing between a residual vibration period in the case of adhesion of paper powder to the nozzle 110 exit and a residual vibration period in the case of ink drying at or around the nozzle 110 exit, it is possible to determine a cause of such ejection abnormality of the ink jet head 100. The determining device 20 determines whether the period Tw of a residual vibration waveform detected by the above ejection-abnormality detecting process is a period within a predetermined range or not, and whether it is longer than a predetermined threshold or not, thereby determining a cause of ejection abnormality.

Figure 24:
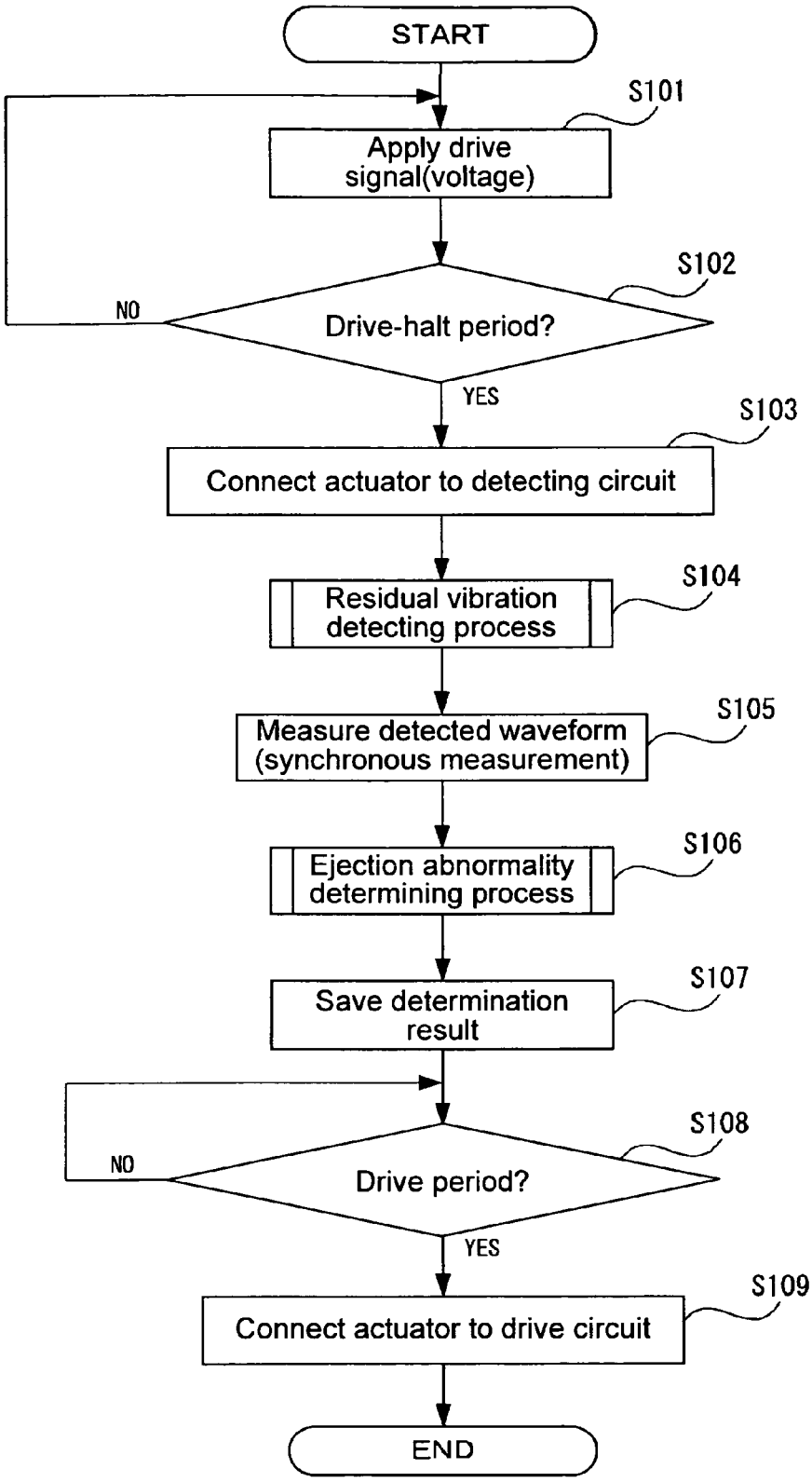
FIG. 24 is a flowchart showing an ejection-abnormality detecting/determining process of the present invention.

Now, explanation is made regarding the operation of the droplet ejecting apparatus of the present invention, on the basis of the structure of the ink jet printer 1. First explained is an ejection-abnormality detecting process (including drive/detection switching process) for the nozzle 110 of one ink jet head 100. FIG. 24 is a flowchart showing an ejection-abnormality detection/determination process of the invention. In case the printing data for printing (or ejection data in a flashing operation) is inputted from the host computer 8 to the control section 6 through the interface (IF) 9, the ejection-abnormal detecting process is executed according to predetermined timing. Incidentally, the flowchart shown in FIG. 24 shows an ejection-abnormality detecting process corresponding to one ink jet head 100, i.e., an ejection operation of one nozzle 110 to simplify the explanation.

First, a drive signal corresponding to printing data (ejecting data) is inputted from the drive circuit 18 of the head driver 33. Due to this, a drive signal (voltage signal) is applied between the respective electrodes of the electrostatic actuator 120, depending upon the timing of the drive signal as shown in the timing chart of FIG. 20 (step S101). The control section 6 determines whether the ink jet head 100 which ejected the ink droplet is in a drive-halt period or not, depending upon a drive/detection switching signal (step S102). Herein, the drive/detection switching signal becomes a High level synchronously with a falling edge of the drive signal (see FIG. 20), and inputted from the control section 6 to the switch device 23.

When the drive/detection switching signal is inputted to the switch device 23, the electrostatic actuator 120, i.e., capacitor constituting the oscillation circuit 11, is disconnected from the drive circuit 18 by the switch device 23, and connected to the ejection-abnormality detecting device 10 (detecting circuit), i.e., oscillation circuit 11 of the residual vibration detecting device 16 (step S103). Then, a residual vibration detecting process, hereinafter described, is executed (step S104), and the measuring device 17 measures a predetermined numeral from the residual vibration waveform data detected in the residual vibration detecting process (step S105). Herein, as described above, the measuring device 17 measures a period of the residual vibration from the residual vibration waveform data.

Next, the determining device 20 carries out an ejection-abnormality detecting process, hereinafter described, depending upon a measurement result by the measuring device (step S106). The determination result is saved in a predetermined storage domain of the EEPROM (storage means) 62 of the control section 6 (step S107). In step S108, it is determined whether the ink jet head 100 is in a drive period or not. Namely, it is determined whether or not the drive-halt period is terminated and the next drive signal is inputted. The process is in standby in step S108 until the next drive signal is inputted.

When the drive/detection switching signal becomes a Low level synchronously with a rising edge of the drive signal in the time of inputting the next drive signal pulse ("yes" in step S108), the switch device 23 switches the connection with the electrostatic actuator 120 from the ejection-abnormality detecting device (detecting circuit) 10 over to the drive circuit 18 (step S109), thus ending the ejection-abnormality detecting process.

Incidentally, the flowchart shown in FIG. 24 explained the case when the measuring device 17 measures a period from the residual vibration waveform detected by the residual vibration detecting process (residual vibration detecting device 16). However, the present invention is not limited to such cases. For example, the measuring device 17 may make a measurement on a phase difference and amplitude of a residual vibration waveform from the residual vibration waveform data detected in the residual vibration detecting process.

Figure 25:
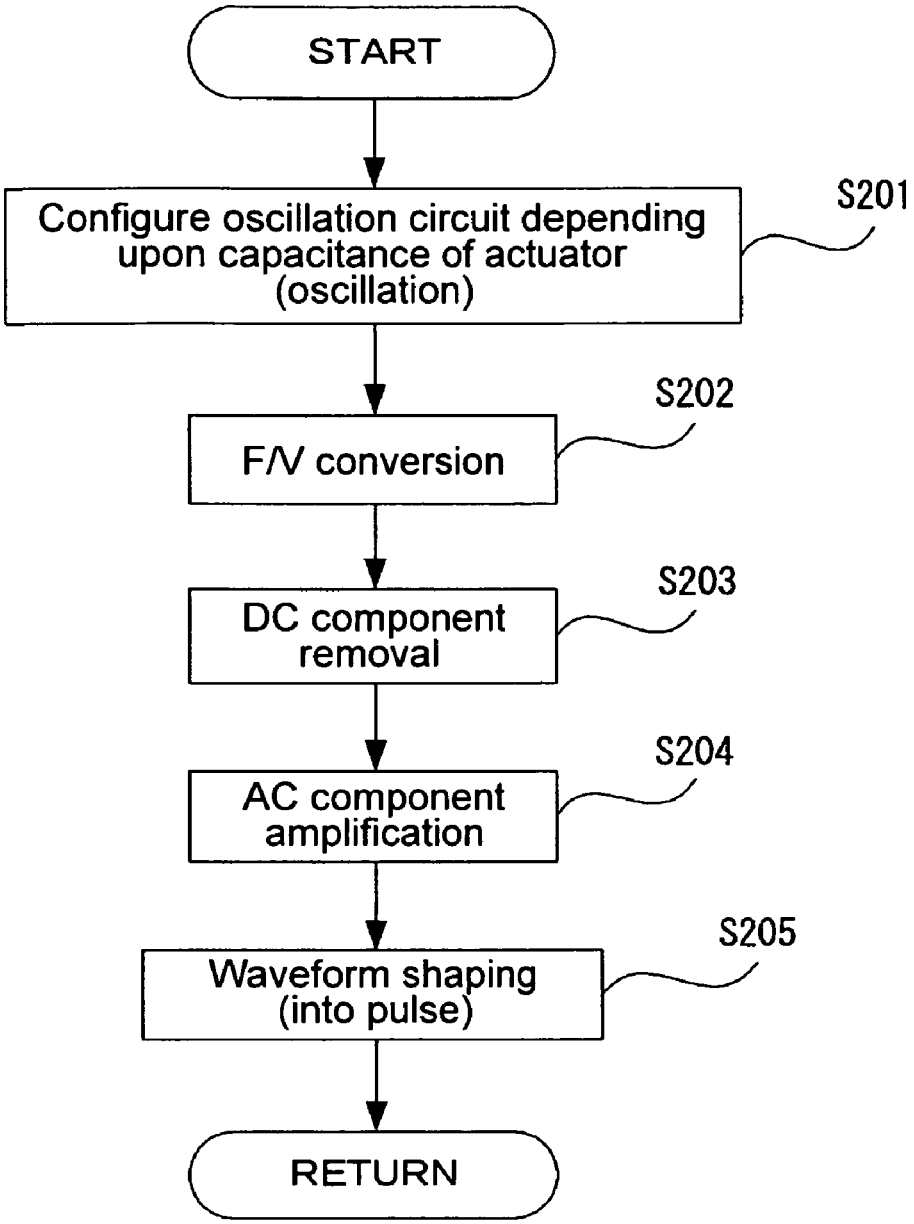
FIG. 25 is a flowchart showing a residual vibration detecting process of the present invention.

Now, explanation is made regarding the residual vibration detecting process (sub-routine) in step S104 of the flowchart shown in FIG. 24. FIG. 25 is a flowchart showing a residual vibration detecting process of the invention. As in the above, in case the electrostatic actuator 120 and the oscillation circuit 11 are connected together by the switch device 23 (step S103 in FIG. 24), the oscillation circuit 11 forms a CR oscillation circuit, to make an oscillation depending upon a capacitance change of the electrostatic actuator 120 (residual vibration on the vibration plate 121 of the electrostatic actuator 120) (step S201).

As shown in the above timing chart, a charge signal, a hold signal, and a clear signal are generated in the F/V converting circuit 12 depending upon an output signal (pulse signal) of the oscillation circuit 11. Based on these signals, the FN conversion circuit 12 carries out an FN conversion process of converting a frequency of an output signal of the oscillation circuit 11 into a voltage (step S202); a residual vibration waveform data on the vibration plate 121 is outputted from the FN conversion circuit 12. The residual vibration waveform data outputted from the FN conversion circuit 12 is stripped of its DC component (direct-current component) by the capacitor C3 of the waveform shaping circuit 15 (step S203). Thus, the operational amplifier 151 amplifies the residual vibration waveform (AC component) free of its DC component (step S204).

The residual vibration waveform data, after amplified, is waveform-shaped by a predetermined process and made into a pulse (step S205). Namely, in this embodiment, the comparator 152 compares between a voltage value (predetermined voltage value) set by the direct-current voltage source Vref2 and an output voltage of the operational amplifier 151. The comparator 152 outputs a binary waveform (rectangular wave) depending upon the comparison result. The output signal of the comparator 152, in other words, an output signal of the residual vibration detecting device 16, is outputted to the measuring device 17 in order to carry out an ejection-abnormality determining process, thus ending the residual vibration detecting process.

Figure 26:
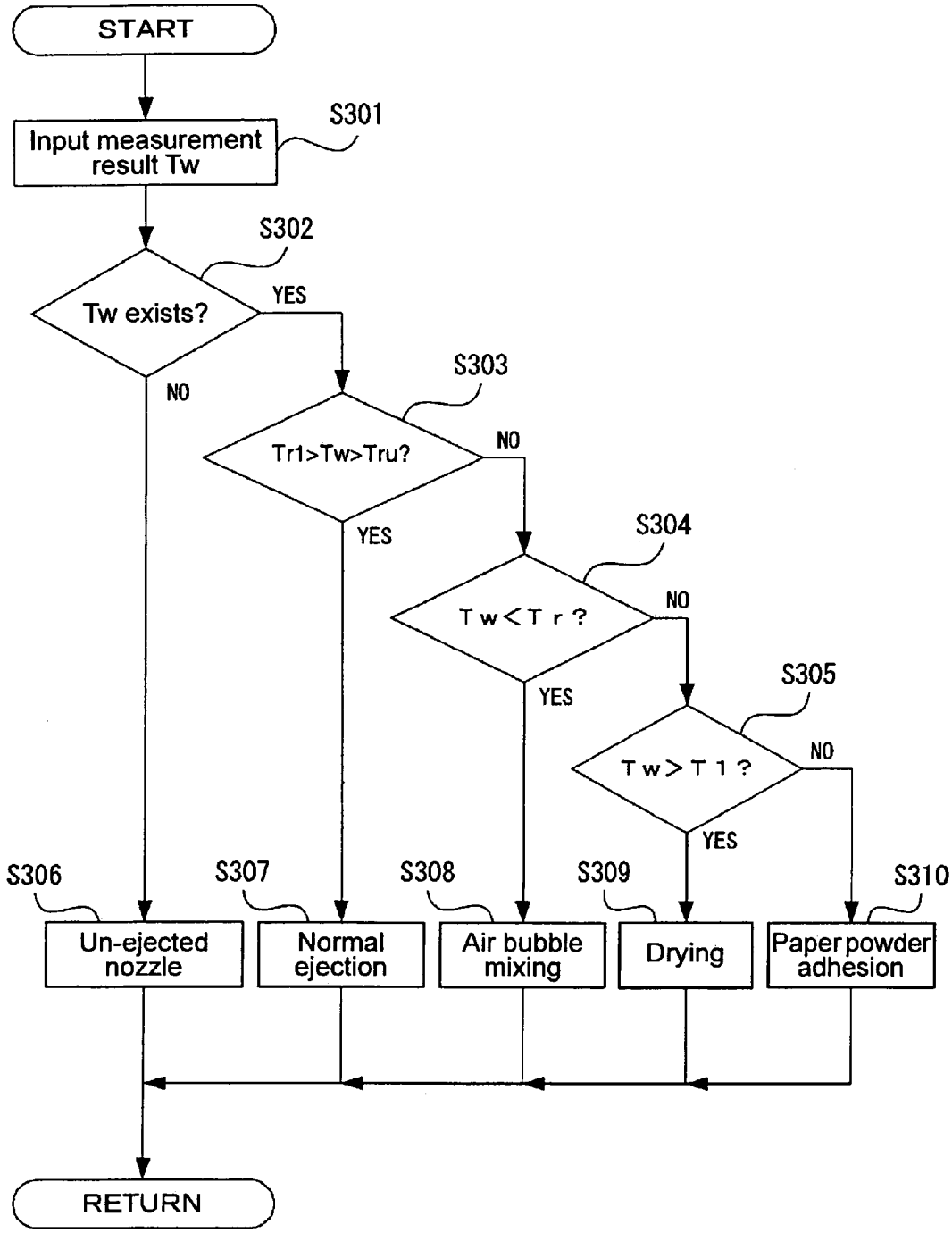
FIG. 26 is a flowchart showing an ejection-abnormality determining process of the present invention.

Now, explanation is made regarding the ejection-abnormality determining process (subroutine) in step S106 of the flowchart shown in FIG. 24. FIG. 26 is a flowchart showing an ejection-abnormality determining process to be executed by the control section 6 and determining device 20 of the present invention. The determining device 20 determines, depending upon the measurement data (measurement result) such as period measured by the measuring device 17, whether an ink droplet has been normally ejected from the relevant ink jet head 100 or not. In the case of non-normal ejection, i.e., in the case of an ejection abnormality, a determination is made as to what caused the abnormality.

First, the control section 6 outputs to the determining device 20 a predetermined range Tr of the period of residual vibration and a predetermined threshold T1 of the period of residual vibration saved in the EEPROM 62. The predetermined range Tr of the period of residual vibration is to provide an allowable range (upper limit Tru, lower limit Tr1) for normal determination to the residual vibration period in normal ejection. These data are stored to a memory (not-shown) of the determining device 20, and the following process is carried out.

The result of the measurement by the measuring device 17 in step S105 of FIG. 24, is inputted to the determining device 20 (step S301). Herein, in this embodiment, the measurement result is a residual vibration period Tw of the vibration plate 121.

In step S302, the determining device 20 determines whether or not there exists a residual vibration period Tw, i.e., whether or not residual vibration waveform data has not been obtained by the ejection-abnormality detecting device 10. When it is determined that there is no residual vibration period Tw, the determining device 20 determines that the nozzle 110 of the ink jet head 100 is an unejected nozzle having not ejected an ink droplet in the ejection-abnormality detecting process (step S306). Meanwhile, when it is determined that there exists residual vibration waveform data, the determining device 20 subsequently in step S303 determines whether the period Tw is within a predetermined range Tr to be recognized as a period in normal ejection.

When the residual vibration period Tw is determined to be within the predetermined range Tr, it means that an ink droplet has been normally ejected from the corresponding ink jet head 100; the determining device 20 determines that the nozzle 110 of the ink jet head 100 has normally ejected an ink droplet (normal ejection) (step S307). Meanwhile, when the residual vibration period Tw is determined not to be within the predetermined range Tr, the determining device 20 subsequently in step S304 determines whether the residual vibration period Tw is shorter than the lower limit Tr1 or not.

When it is determined that the residual vibration period Tw is shorter than the lower limit Tr1, it means that the frequency of residual vibration is high; as in the foregoing, it can be considered that an air bubble has mixed in the cavity 141 of the ink jet head 100; the determining device 20 determines that an air bubble has been mixed in the cavity 141 of the ink jet head 100 (air bubble mixing) (step S308).

When it is determined that the residual vibration period Tw is longer than the upper limit Tru, the determining device 20 subsequently determines whether the residual vibration period Tw is longer than the predetermined threshold T1 or not (step S305). When it is determined that the residual vibration period Tw is longer than the predetermined threshold T1, it can be considered that the residual vibration is in excessive attenuation. Thus, the determining device 20 determines that the ink at or around the nozzle 110 of the ink jet head 100 is thickened (dried) by drying (step S309).

Then, in step S305, in the case that the residual vibration period Tw is determined to be shorter than the predetermined threshold T1, the residual vibration period Tw is a value in a range satisfying Tru<Tw<T1. As in the foregoing, it can be considered as paper powder adhesion to a vicinity of the nozzle 110 higher in frequency rather than drying. The determining device 20 determines that paper powder is adhered in a vicinity of the nozzle 110 exit of the ink jet head 100 (paper powder adhesion) (step S310).

In this manner, in case the determining device 20 determines normal ejection or a cause or the like of an ejection abnormality on the ink jet head 100 under consideration (steps S306–S310), the determination result is outputted to the control section 6, thus ending the ejection-abnormality determining process.

As in the above, in the droplet ejecting apparatus (ink jet printer 1) and ejection abnormality detecting/determining method for a droplet ejecting head of this embodiment, the electrostatic actuator 120 is driven to thereby make an operation of ejecting liquid as a droplet from the droplet ejection head 100. Thereupon, the residual vibration detecting device 16 detects a residual vibration of the vibration plate 121 displaced by the electrostatic actuator 120. The measuring device 17 measures a vibration pattern (e.g., residual vibration waveform period, amplitude and the like) of the residual vibration of the vibration plate 121 detected by the residual vibration detecting device 16. Based on the measurement result, the determining device 20 determines whether a droplet has been normally ejected or non-normally ejected (ejection abnormality) and, when there is an ejection abnormality, what caused the abnormality.

Consequently, the droplet ejecting apparatus and ejection abnormality detecting/determining method for a droplet ejecting head of this invention does not require the other parts (e.g., optical dot-missing detecting device) as compared to the droplet ejection head/apparatus having the conventional dot-missing detecting method (e.g., optical detecting method). Accordingly, it is possible to detect a droplet-ejection abnormality without increasing the size of the droplet ejection head. Furthermore, it is possible to suppress the manufacturing cost of the droplet ejecting apparatus for detecting an ejection abnormality (dot missing). Meanwhile, in the droplet ejecting apparatus of the present invention, because the residual vibration of the vibration plate after ejection is used to detect a droplet-ejection abnormality, a droplet-ejection abnormality can be detected even during a printing operation. Accordingly, even in case the ejection-abnormality detecting/determining method of the present invention is carried out during a printing operation, there is no possibility of lowering or worsening the throughput of the droplet electing apparatus.

Meanwhile, the droplet ejecting apparatus of the invention can determine a cause of the droplet-ejection abnormality that is impossible to determine by a conventional apparatus for detecting dot missing, such as an optical detecting apparatus. Due to this, it is possible to select and carry out a suitable recovery process on the cause, as required.

SECOND EMBODIMENT

Now, explanation is made regarding another structural example of ink jet head of the present invention. FIGS. 27 to 30 are sectional views respectively showing the outlines of the other structural examples of the ink jet head 100. Although the explanation in the following is based on these figures, explanation is by centering on the difference from the foregoing embodiment while omitting explanations of similar matter.

Figure 27:
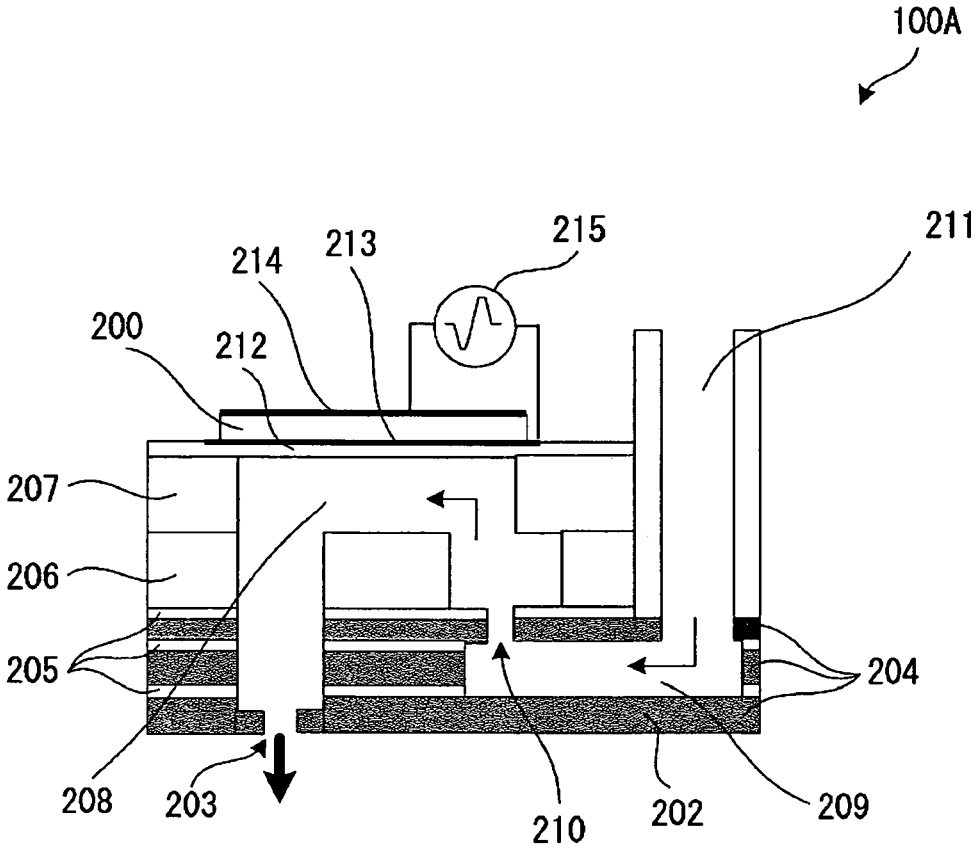
FIG. 27 is a sectional view showing another structural example of an ink jet head of the present invention.

An ink jet head 100A shown in FIG. 27 has a vibration plate 212 to be vibrated by the drive of a piezoelectric element 200, to eject the ink (liquid) within a cavity 208 through a nozzle 203. A stainless steel nozzle plate 202, formed with the nozzle (ports) 203, is bonded with a stainless steel metal plate 204 through an adhesive film 205, on which a similar stainless steel metal plate 204 is further bonded through an adhesive film 205. Furthermore, a communication-port-formed plate 206 and a cavity plate 207 are bonded thereon.

The nozzle plate 202, the metal plate 204, the adhesive plate 205, the communication-port-formed plate 206, and the cavity plate 207 are respectively formed in predetermined forms (forms to form a recess). By superposing these elements, the cavity 208 and a reservoir 209 are formed. The cavity 208 and the reservoir 209 are in communication through an ink supply port 210. Meanwhile, the reservoir 209 communicates with an ink intake port 211.

The vibration plate 212 is arranged over an upper-surface opening of the cavity plate 207. This vibration plate 212 is bonded with a piezoelectric element 200 through a lower electrode 213. Meanwhile, an upper electrode 214 is bonded on the piezoelectric element 200 opposite to the lower electrode 213. A head drive 215 has a drive circuit for generating a drive voltage waveform. By applying (supplying) a drive voltage waveform between the upper electrode 214 and the lower electrode 213, the piezoelectric element 200 is driven to thereby drive the vibration plate 212 bonded therewith. Vibrating the vibration plate 212 causes a bulk (pressure within the cavity) change in the cavity 208, to eject as a droplet the ink (liquid) filled within the cavity 208 through the nozzle 203.

As for the amount of liquid reduced in the cavity 208 due to droplet ejection, ink is supplied and replenished from the reservoir 209. Meanwhile, ink is supplied to the reservoir 209 through the ink intake port 211.

Figure 28:
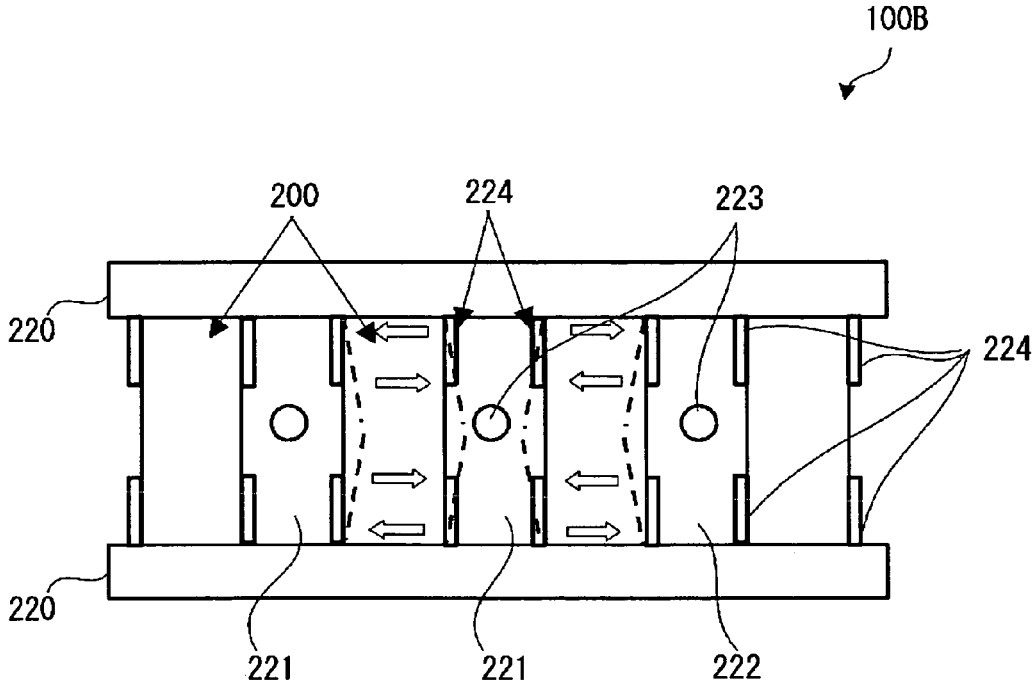
FIG. 28 is a sectional view showing another structural example of an ink jet head of the present invention.

Regarding an ink jet head 100B shown in FIG. 28, the ink (liquid) within a cavity 221 is ejected through a nozzle by driving the piezoelectric element 200 similarly to the foregoing. This ink jet head 100B has a pair of opposed substrates 220. A plurality of piezoelectric elements 200 are arranged intermittently with predetermined spacing between the both substrate 220.

Between the adjacent ones of the piezoelectric elements 200, the cavities 221 are formed. The cavity 221 has a plate (riot shown) arranged frontward of FIG. 28 and a nozzle plate 222 arranged rearward thereof. The nozzle plate 222 has a nozzle (port) 223 formed in a position corresponding to each cavity 221.

A pair of electrodes 224 is arranged respectively on one and the other surfaces of the piezoelectric element 200. Namely, four electrodes 224 are bonded on one piezoelectric element 200. By applying a predetermined drive voltage waveform between predetermined ones of these electrodes 224, the piezoelectric element 200 is deformed under shear mode into vibration (shown by the arrows in FIG. 28). The vibration causes a bulk change (pressure within the cavity) of the cavity 221, to eject as a droplet the ink (liquid) filled within the cavity 221 through the nozzle 223. Namely, on the ink jet head 10B, the piezoelectric element 200 itself functions as a vibration plate.

Figure 29:
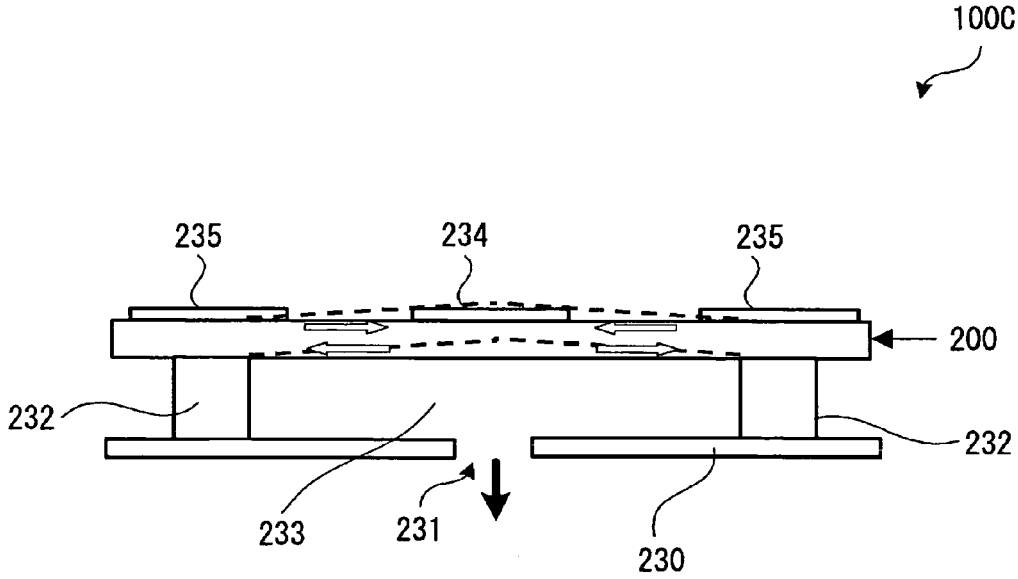
FIG. 29 is a sectional view showing another structural example of an ink jet head of the present invention.

Regarding an ink jet head 100C shown in FIG. 29, the ink (liquid) within a cavity 233 is ejected through a nozzle 231 by driving the piezoelectric element 200 similarly to the foregoing. This ink jet head 100C has a nozzle plate 230 formed with the nozzle 231, a spacer 232, and the piezoelectric element 200. The piezoelectric element 200 is arranged spaced a predetermined distance from the nozzle plate 230 through the spacer 232. The cavity 233 is formed in a space surrounded by the nozzle plate 230, the piezoelectric element 200, and the spacer 232.

A plurality of electrodes is bonded on the upper surface in FIG. 29 of the piezoelectric element 200. Namely, a first electrode 234 is bonded on nearly a center of the piezoelectric element 200, and second electrodes 235 are bonded on the respective sides thereof. By applying a predetermined drive voltage waveform between the first electrode 234 and the second electrodes 235, the piezoelectric element 200 is deformed under shear mode into vibration (shown by the arrows in FIG. 29). The vibration causes a bulk change (pressure within the cavity) of the cavity 233, to eject as a droplet the ink (liquid) filled within the cavity 233 through the nozzle 231. Namely, on the ink jet head 100C, the piezoelectric element 200 itself functions as a vibration plate.

Figure 30:
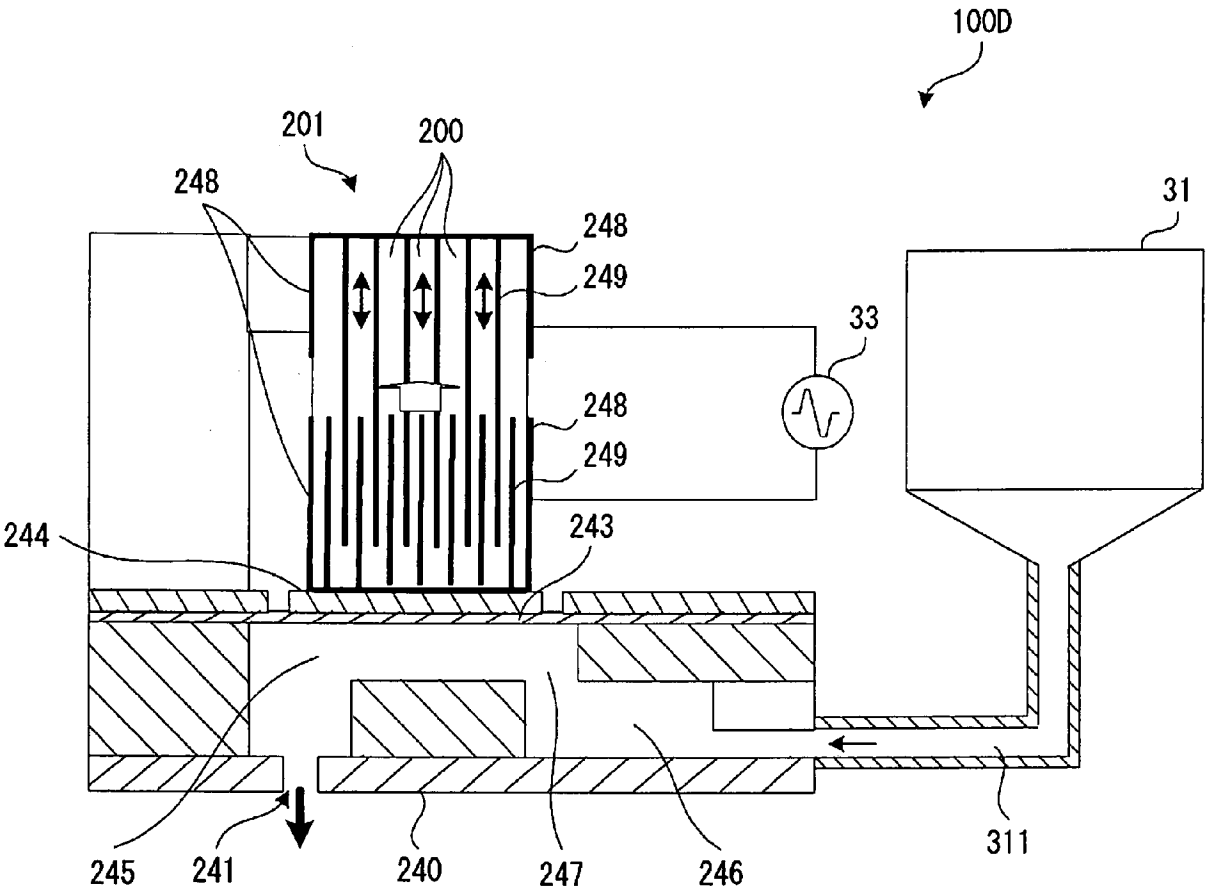
FIG. 30 is a sectional view showing another structural example of an ink jet head of the present invention.

Regarding the ink jet head 100D shown in FIG. 30, the ink (liquid) within a cavity 245 is ejected through a nozzle 241 by driving the piezoelectric element 200. This ink jet head 100D has a nozzle plate 240 formed with the nozzle 241, a cavity plate 242, a vibration plate 243, and a laminated piezoelectric element 201 having a lamination of a plurality of piezoelectric elements 200.

The cavity plate 242 is formed in a predetermined form (form for forming a recess), thereby forming the cavity 245 and a reservoir 246. The cavity 245 and the reservoir 246 communicate together through an ink supply port 247. Meanwhile, the reservoir 246 communicates with an ink cartridge 31 through an ink supply tube 311.

The laminated piezoelectric element 201 has a lower end in FIG. 30 bonded with the vibration plate 243 through an intermediate layer 244. A plurality of external electrodes 248 and internal electrodes 249 are joined with the laminated piezoelectric element 201. Namely, the laminated piezoelectric element 201 is joined with the external electrode 248 on its outer surface. The internal electrodes 249 are arranged between the piezoelectric elements 200 (or internally of the piezoelectric elements) constituting the laminated piezoelectric element 201. In this case, the external electrode 248 and the internal electrodes 249 are arranged in a manner partly, alternately overlapped in the thickness direction of the piezoelectric element 200.

By applying a drive voltage waveform between the external electrode 248 and the internal electrodes 249 from the head drive 249, the laminated piezoelectric element 201 deforms as shown by the arrow in FIG. 30 (expands and contracts vertically in FIG. 30) into vibration. By this vibration, the vibration plate 243 is vibrated. Vibrating the vibration plate 243 causes a bulk (pressure within the cavity) change in the cavity 245, to eject as a droplet the ink (liquid) filled within the cavity 245 through the nozzle 241.

As for the amount of liquid reduced in the cavity 245 due to droplet ejection, ink is supplied and replenished from the reservoir 246. Meanwhile, ink is supplied to the reservoir 246 from the ink cartridge 31 through the ink supply tube 311.

In the ink jet heads 100A–100D having the piezoelectric element as in the above, an abnormality of droplet ejection can be detected or a cause of the abnormality can be specified depending upon the residual vibration of the vibration plate or the piezoelectric element functioning as a vibration plate similarly to the foregoing capacitance type ink jet head 100. Incidentally, on the ink jet heads 100B and 100C, a vibration plate (vibration plate for detecting residual vibration) as a sensor can be structurally provided in a position facing the cavity, to detect the residual vibration on this vibration plate.

As in the above, in the droplet ejecting apparatus and ejection abnormality detecting/determining method for a droplet ejecting head of this embodiment, the electrostatic actuator or piezoelectric actuator is driven to make an operation of ejecting liquid as a droplet from the liquid droplet ejection head. Thereupon, detected is the residual vibration on the vibration plate displaced by the actuator. Based on the residual vibration on the vibration plate, detection is made as to whether a droplet has been ejected normally or has not been ejected normally (ejection abnormality).

Meanwhile, a cause of the obtained droplet ejection abnormality is determined, on the basis of the vibration patterns of residual vibration on the vibration plate (e.g., residual vibration waveform period, etc.).

Accordingly, the invention does not require the other parts (e.g., optical dot-missing detecting device) as compared to the droplet ejection head/apparatus having the conventional dot-missing detecting method. Accordingly, it is possible to detect a droplet-ejection abnormality without increasing the size of the droplet ejection head, and to suppress manufacturing costs. Meanwhile, in the droplet ejection head of the invention, because the residual vibration on the vibration plate after ejection is used to detect a droplet-ejection abnormality, a droplet-ejection abnormality can be detected even during a printing operation.

Meanwhile, the droplet ejecting apparatus of the invention can determine a cause of droplet-ejection abnormality that is impossible to determine by a conventional apparatus for detecting dot missing, such as an optical detecting apparatus. Due to this, it is possible to select and carry out a suitable recovery process on the cause, as required.

In the above, although the droplet ejecting apparatus and ejection abnormality detecting/determining method for a droplet ejecting head of the invention was explained on the basis of the illustrated embodiments, the invention is not limited to those. The parts constituting the droplet ejection head or droplet ejecting apparatus can be replaced with a desired structure capable of exhibiting a similar function. Meanwhile, another desired structure may be added to the droplet ejection head or droplet ejecting apparatus of the invention.

Incidentally, there is no special limitation in the ejection liquid (droplets) to be ejected from the droplet ejection head (ink jet head 100, in the foregoing embodiment) of the droplet ejecting apparatus of the present invention. For example, it can be a liquid containing various materials (including dispersion liquids such as suspension or emulsion). Namely, included are an ink containing a filter material for a color filter, a luminescent material for forming an EL luminescent layer in an organic EL (Electro Luminescence) device, a fluorescent material for forming a phosphor on an electrode in an electron emission device, a fluorescent material for forming a phosphor in a PDP (Plasma Display Panel), an electrophoretic material for forming an electrophoretic matter in an electrophoretic display device, a bank material for forming a bank on the surface of a substrate W, various coating materials, a liquid electrode material for forming an electrode, a particular material for structuring a spacer for forming a fine cell gap between two substrates, liquid metal material for forming a metal interconnection, a lens material for forming a micro-lens, a resist material, a light-diffusing material for forming a light diffusing member, and so on.

Meanwhile, in the invention, the droplet receiver as a subject of droplet ejection may be another media such as a film, a fabric and a non-fabric, or a work piece such as a glass substrate or a silicon substrate, without limited to paper such as a recording paper.

What is claimed is:

1. A droplet ejecting apparatus comprising:

a droplet ejecting head including:

a vibration plate;

an actuator for displacing the vibration plate;

a cavity filled with a liquid and having an interior pressure to be increased and decreased by a displacement of the vibration plate; and a nozzle communicating with the cavity and for ejecting the liquid as a droplet depending upon an increase and decrease of the pressure within the cavity;

a drive circuit for driving the actuator; and an ejection abnormality detecting device having a residual vibration detecting device for detecting residual vibration of the vibration plate displaced by the actuator after the actuator is driven by the drive circuit, to detect an abnormality of droplet ejection depending upon a vibration pattern of the residual vibration of the vibration plate detected by the residual vibration detecting device, the ejection abnormality detecting device including a determining device for determining a presence or absence of a droplet ejection abnormality of the droplet ejection head depending upon the vibration pattern of residual vibration of the vibration plate;

wherein the determining device determines a cause of the ejection abnormality when the presence of a droplet ejection abnormality is determined;

wherein the vibration pattern of the residual vibration of the vibration plate includes a period of the residual vibration; and wherein, when the period of the residual vibration of the vibration plate is shorter than a predetermined first period, the determining device determines that the cause of the droplet ejection abnormality is that there is an air bubble mixed in the cavity.

2. The droplet ejecting apparatus according to claim 1, wherein, when the period of the residual vibration of the vibration plate is longer than a predetermined second period but shorter than a predetermined third period, the determining device determines that the cause of the droplet ejection abnormality is that there is paper powder adhered to a vicinity of an exit of the nozzle, wherein the second period is longer than the first period and the third period is longer than the second period.

3. The droplet ejecting apparatus according to claim 2, wherein, when the period of the residual vibration of the vibration plate is longer than said predetermined third period, the determining device determines that the cause of the droplet ejection abnormality is that there is a thickened liquid in a vicinity of the nozzle.

4. The droplet ejecting apparatus according to claim 1, further comprising a storage device for storing a result of the determination made by the determining device.

5. The droplet ejecting apparatus according to claim 1, further comprising a switch device for switching, after a droplet ejecting operation by the actuator, the actuator from the drive circuit to the ejection abnormality detecting device.

6. The droplet ejecting apparatus according to claim 1, wherein the residual vibration detecting device has an oscillation circuit, the oscillation circuit oscillating based on a capacitance component of the actuator varying depending upon the residual vibration of the vibration plate.

7. The droplet ejecting apparatus according to claim 6, wherein the oscillation circuit comprises a CR oscillation circuit having a capacitance component of the actuator and a resistance component of a resistance element connected to the actuator.

8. The droplet ejecting apparatus according to claim 6, wherein the oscillation circuit has an oscillation frequency configured one figure higher than a vibration frequency of the residual vibration of the vibration plate.

9. The droplet ejecting apparatus according to claim 6, wherein the residual vibration detecting device includes an F/V conversion circuit for generating a voltage waveform of the residual vibration of the vibration plate from a predetermined signal group generated based on an oscillation frequency change in an output signal of the oscillation circuit.

10. The droplet ejecting apparatus according to claim 9, wherein the residual vibration detecting device includes a waveform shaping circuit for shaping a voltage waveform of the residual vibration of the vibration plate generated by the F/V conversion circuit into a predetermined waveform.

11. The droplet ejecting apparatus according claim 10, wherein the waveform shaping circuit includes a DC component removing device for removing a direct-current component from a voltage waveform of the residual vibration of the vibration plate generated by the F/V conversion circuit, and a comparator for comparing between a voltage waveform removed from the direct-current component by the DC component removing device and a predetermined voltage value, the comparator generating and outputting a rectangular wave depending upon the voltage comparison.

12. The droplet ejecting apparatus according claim 11, wherein the ejection abnormality detecting device includes a measuring device for measuring a period of the residual vibration of the vibration plate from the rectangular wave generated by the residual vibration detecting device.

13. The droplet ejecting apparatus according claim 12, wherein the measuring device has a counter, the counter counting pulses of a reference signal to thereby measure a time between at least one of rising edges of the rectangular waves, and rising and falling edges of the rectangular waves.

14. The droplet ejecting apparatus according to claim 1, wherein the actuator comprises an electrostatic actuator.

15. The droplet ejecting apparatus according to claim 1, wherein the actuator comprises a piezoelectric actuator utilizing a piezoelectric effect of a piezoelectric element.

16. A droplet ejecting head ejection abnormality detecting/determining method comprising the steps of:

detecting residual vibration of a vibration plate after carrying out an operation for ejecting a liquid within a cavity as a droplet from a nozzle by driving an actuator to vibrate the vibration plate;

detecting a droplet ejection abnormality; and determining a cause of the droplet ejection abnormality depending upon a detected vibration pattern of the residual vibration of the vibration plate, the vibration pattern of the residual vibration of the vibration plate including a period of the residual vibration;

determining that the cause of the droplet ejection abnormality is that there is an air bubble mixed in the cavity when the period of the residual vibration of the vibration plate is shorter than a predetermined first period;

determining that the cause of the droplet ejection abnormality is that there is paper powder adhered to a vicinity of an exit of the nozzle when the period of the residual vibration of the vibration plate is longer than a predetermined second period but shorter than a predetermined third period, wherein the second period is longer than the first period and the third period is longer than the second period;

determining that the cause of the droplet ejection abnormality is that there is a thickened liquid in a vicinity of the nozzle when the period of the residual vibration of the vibration plate is longer than said predetermined third period.

* * * * *